US010680332B1

(12) United States Patent
Li et al.

(10) Patent No.: US 10,680,332 B1
(45) Date of Patent: Jun. 9, 2020

(54) HYBRID MULTI-BAND ANTENNA ARRAY

(71) Applicant: INDUSTRIAL TECHNOLOGY RESEARCH INSTITUTE, Hsinchu (TW)

(72) Inventors: Wei-Yu Li, Hsinchu (TW); Wei Chung, Hsinchu (TW); Kin-Lu Wong, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 17 days.

(21) Appl. No.: 16/234,780

(22) Filed: Dec. 28, 2018

(51) Int. Cl.

| | |
|---|---|
| ***H01Q 5/42*** | (2015.01) |
| ***H01Q 7/00*** | (2006.01) |
| ***H01Q 21/06*** | (2006.01) |
| ***H01Q 21/28*** | (2006.01) |

(52) U.S. Cl.
CPC ..... *H01Q 5/42* (2015.01); *H01Q 7/00* (2013.01); *H01Q 21/064* (2013.01); *H01Q 21/28* (2013.01)

(58) Field of Classification Search
CPC ..... H01Q 5/42; H01Q 7/00; H01Q 21/064; H01Q 21/28
See application file for complete search history.

(56) References Cited

U.S. PATENT DOCUMENTS

| | | | |
|---|---|---|---|
| 5,039,994 | A | 8/1991 | Wash et al. |
| 6,396,460 | B2 | 5/2002 | Tseng et al. |
| 6,459,413 | B1 | 10/2002 | Tseng et al. |
| 6,788,257 | B2 | 9/2004 | Fang et al. |
| 8,436,774 | B2 | 5/2013 | Wong et al. |

(Continued)

FOREIGN PATENT DOCUMENTS

| | | |
|---|---|---|
| CN | 106654562 | 5/2017 |
| CN | 107069208 | 8/2017 |

(Continued)

OTHER PUBLICATIONS

Yu, et al. "A Novel 28 GHz Beam Steering Array for 5G Mobile Device With Metallic Casing Application", IEEE Transactions on Antennas and Propagation; Jan. 2018; vol. 66, Issue 1, 462-466.

(Continued)

*Primary Examiner* — Ab Salam Alkassim, Jr.
(74) *Attorney, Agent, or Firm* — Amin, Turocy & Watson, LLP

(57) ABSTRACT

Provided is a hybrid multi-band antenna array, including: a multilayer substrate board including a ground conductor structure having a first edge; a first antenna array including a plurality of folded loop antennas, all of which being integrated with the multilayer substrate board and arranged along the first edge sequentially, wherein the first antenna array is excited to generate a first resonant mode covering at least one first communication band; and a second antenna array including a plurality of parallel-connected slot antennas, all of which being integrated with the multilayer substrate board and arranged along the first edge sequentially, wherein the second antenna array is excited to generate a second resonant mode covering at least one second communication band, and a frequency of the second resonant mode is lower than a frequency of the first resonant mode.

15 Claims, 17 Drawing Sheets

(56) References Cited

U.S. PATENT DOCUMENTS

| | | | | |
|---|---|---|---|---|
| 8,854,273 | B2 * | 10/2014 | Li | H01Q 5/35 343/741 |
| 9,667,290 | B2 | 5/2017 | Ouyang et al. | |
| 9,742,077 | B2 | 8/2017 | Pan | |
| 2009/0140943 | A1 | 6/2009 | Ratni | |
| 2012/0274532 | A1 * | 11/2012 | Kurashima | H01Q 1/243 343/833 |
| 2013/0002501 | A1 * | 1/2013 | Li | H01Q 5/35 343/767 |
| 2013/0063313 | A1 * | 3/2013 | Ban | H01Q 13/106 343/700 MS |
| 2014/0240186 | A1 | 8/2014 | Zhou et al. | |
| 2014/0361946 | A1 | 12/2014 | Ganchrow et al. | |
| 2015/0035714 | A1 | 2/2015 | Zhou | |
| 2015/0311588 | A1 * | 10/2015 | Wong | H01Q 7/00 342/374 |
| 2015/0340757 | A1 | 11/2015 | Rho et al. | |
| 2016/0049736 | A1 | 2/2016 | Liu et al. | |
| 2017/0110787 | A1 | 4/2017 | Ouyang et al. | |
| 2017/0117635 | A1 | 4/2017 | Ganchrow et al. | |
| 2017/0141465 | A1 * | 5/2017 | Sharawi | H01Q 1/48 |
| 2017/0155185 | A1 | 6/2017 | Hong et al. | |
| 2017/0302306 | A1 | 10/2017 | Ouyang et al. | |
| 2017/0309991 | A1 | 10/2017 | Noori et al. | |

FOREIGN PATENT DOCUMENTS

| | | |
|---|---|---|
| CN | 107123852 | 9/2017 |
| CN | 108400450 | 8/2018 |
| CN | 108493600 | 9/2018 |
| TW | 200835057 | 8/2008 |
| TW | 201212387 | 3/2012 |
| TW | M504952 | 7/2015 |
| TW | I568080 | 1/2017 |
| TW | 201824647 | 7/2018 |
| TW | I629836 | 7/2018 |

OTHER PUBLICATIONS

Ahmad, et al. "Small Form Factor Dual Band (28/38 GHz) PIFA Antenna for 5G Applications", IEEE MTT-S International Conference on Microwaves for Intellilent Mobility; Mar. 2017.

Peng, et al. "High Performance 5G Millimeter-Wave Antenna Array for 37-40 GHz Mobile Application", International Workshop on Antenna Technology; Mar. 2018; 1-4.

Bang, et al. "MM-Wave Phased Array Antenna for Whole-Metal-Covered 5G Mobile Phone Application", International Symposium on Antennas; Nov. 2017.

Aliakbari, et al. "A Single Feed Dual-band Circularly Polarized Millimeter-wave Antenna for 5G Communication", 10th European Conference on Antennas and Propagation; Apr. 2016.

Rahman, et al. "A Wideband mm-Wave Printed Dipole Antenna for 5G Applications", Indonesia Journal of Electrical Engineering and Computer Science; Jun. 2018; vol. 10, No. 3, 943-950.

Rajo-Iglesias, et al. "5G Antenna in Inverted Microstrip Gap Waveguide Technology Including a Transition to Microstrip", International Syumposium on Antennas; Oct. 2016.

Hong, et al. "Millimeter-Wave 5G Antennas for Smartphones: Overview and Experimental Demonstration", IEEE Transactions on Antennas and Propagation; Dec. 2017; vol. 65, Issue 12, 6250-6261.

Hong, et al. "Quantitative Analysis of the effects of Polarization and Pattern Reconfiguration for mmWave 5G Mobile Antenna Prototypes", IEEE Radio and Wireless Symposium; Jan. 2017.

Ta, et al. "Broadband Printed-Dipole Antenna and its Arrays for 5G Applications", IEEE Antennas and Wireless Propagation; May 2017; vol. 16, 2183-2186.

Mahmoud, et al. "Design of dual-band circularly polarised array antenna package for 5G mobile terminals with beam-steering capabilities", IET Microwaves, Antennas & Propagation; 2018; vol. 12. Issue 12.

El-Halwagy, et al. "A 28 GHz Compact Vertically-Polarized Dipole for 5G Smartphone Edge", IEEE International Symposium on Antennas and Prepagation & USNC/URSI National; Jul. 2017.

Stanley, et al. "A High Gain Steerable Millimeter-Wave Antenna Array for 5G Smartphone Applications", 11th European Conference on Antennas and Propagation; Mar. 2017.

Stanley, et al. "A Novel mm-Wave Phased Array Antenna with 360 Degree Coverage for 5G Smartphone Applications", 10th UK-Europe-China workshop on Millimetre; Sep. 2017.

Ojaroudiparchin, et al. "A Switchable 3-D-Coverage-Phased Array Antenna Package for 5G Mobile Terminals", IEEE Antennas and Wireless Propagation Letters; Feb. 2016; vol. 15, 1747-1750.

Ali, et al. "Broadband Printed Slot Antenna for the Fifth Generation (5G) Mobile and Wireless Communications", 17th International Symposium on Antenna Technology and Applied Electromagnetics; Jul. 2016.

Dadgarpour, et al. "Wideband Low-Loss Magnetoelectric Dipole Antenna for 5G Wireless Network With Gain Enhancement Using Meta Lens and Gap Waveguide Technology Feeding", IEEE Transactions on Antennas and Propagation; Dec. 2016; vol. 64, Issue. 12, 5094-5101.

Xia, et al. "Design and Analysis of a Compact Reconfigurable Phased Antenna Array with 3D Coverage for 5G Applications in Portable Devices", Progress in Electromagetic Research Symposium; Aug. 2016.

Ojaroudiparchin, et al. "Beam-Steerable Microstrip-Fed Bow-Tie Antenna Array for Fifth Generation Cellular Communications", 10th European Conference on Antennas and Propagation; Apr. 2016.

Ojaroudiparchin, et al. "Multi-Layer 5G Mobile Phone Antenna for Multi-User MIMO Communications", 23rd Telecommunications Forum Telfor (TELFOR); Nov. 2015.

Haraz, et al. "Design of a 28/38 GHz Dual-Band Printed Slot Antenna for the Future 5G Mobile Communication Networks", IEEE International Symposium on Antennas and Propagation & USNC/URSI; Jul. 2015.

Ojaroudiparchin, et al. "Design of Vivaldi Antenna Array with End-Fire Beam Steering Function for 5G Mobile Terminals", 23rd Telecommunications Forum Telfor; Nov. 2015.

Hong, et al. "Design and Analysis of a Low-Profile 28GHz Beam Steering Antenna Solution for Future 5G Cellular Applications", IEEE MTT-S International Microwave Symposium; Jun. 2014.

Taiwanese Decision Grant for Taiwanese Patent Application No. 107147720 dated Aug. 21, 2019.

* cited by examiner

7

HYBRID MULTI-BAND ANTENNA ARRAY

BACKGROUND

1. Technical Field

This disclosure relates to multi-band antenna arrays, and, more particularly, to a compact highly integrated multi-band antenna array that can increase the data throughput of a communication device at different frequency bands.

2. Description of Related Art

Due to the increasing demands of quality and transmission throughput for wireless and mobile communication signals, millimeter wave communication technology is under rapid development. The millimeter wave communication technology could utilize more bandwidth resources to increase the transmission throughput of wireless data, and would become one of the most promising next-generation Multi-Gbps communication systems. However, comparing to the applications of sub-6 GHz communication bands, the millimeter wave communication bands would have relatively higher wireless transmission path loss. Therefore, beamforming antenna array architectures which could achieve higher antenna gains, higher radiation directivities and multiple beam scanning functions would become an important and critical key technologies for millimeter wave communication applications. In addition, because different countries could adopt to use different millimeter wave bands for wireless communications, therefore how a beamforming antenna array architecture could achieve multi-band operation is already becoming an important research topic.

In the prior arts, for the applications of millimeter wave communications, many highly-integrated beamforming antenna array architectures which could achieve only single band operation have already been published. And some of prior arts propose to design a single beamforming antenna array which could generate a wideband resonant mode to cover different communication bands operations. However, theoretically speaking, for different millimeter wave communication bands operations, the corresponding optimized antenna arrays would need to have different intervals between antenna array units. Therefore, the design approaches used in the prior arts for designing a single antenna array to excite a wide band resonant mode to achieve different millimeter wave bands operations, would lead to grating lobe problems in different frequency bands.

The grating lobe issues could be suppressed effectively by designing different beamforming antenna arrays with respectively corresponding different optimized array unit intervals for covering different millimeter wave bands operations. However, the different beamforming antenna arrays for different bands operations would need to be placed with proper isolation distances for preventing mutual coupling effect to cause distortion on far field radiation patterns at different operating bands. But this arrangement would need to occupy a larger placement space and cause bad space utilization rate.

Therefore, how to compactly design multiple beamforming antenna arrays that could successfully support multi-band operations within a space-limited communication device is an important issue needed to be solved. Accordingly, a highly integrated multi-band antenna array that could solve the problems of the prior arts to meet the requirements of the next-generation communication device that could achieve different millimeter wave bands operations is needed in the art.

SUMMARY

In view of the drawbacks of the prior art, this disclosure provides a hybrid multi-band antenna array to overcome the drawbacks.

According to an embodiment, this disclosure provides a hybrid multi-band antenna array, comprising: a multilayer substrate board including a ground conductor structure having a first edge; a first antenna array including a plurality of folded loop antennas, all of the folded loop antennas being integrated with the multi-layer substrate board and arranged along the first edge sequentially, wherein each of the folded loop antennas includes a meandered metal resonant path, each of the meandered metal resonant paths has a loop shorting point and a loop feeding point, each of the loop shorting point is electrically connected to the ground conductor structure, two neighboring ones of the loop feeding points are respectively spaced apart at a first interval, and the first antenna array is excited to generate a first resonant mode covering at least one first communication band; and a second antenna array including a plurality of parallel-connected slot antennas, all of the parallel-connected slot antennas being integrated with the multilayer substrate board and arranged along the first edge sequentially, wherein each of the parallel-connected slot antennas includes a first slot, a second slot and a signal coupling line extending across the first slot and the second slot, all of the first slots and all of the second slots are disposed on the ground conductor structure, each of the signal coupling lines has a slot feeding point, any two neighboring ones of the slot feeding points are respectively spaced apart at a second interval, and the second antenna array is excited to generate a second resonant mode covering at least one second communication band, and wherein the frequency of the second resonant mode is lower than the frequency of the first resonant mode.

BRIEF DESCRIPTION OF DRAWINGS

The disclosure can be more fully understood by reading the following detailed description of the embodiments, with reference made to the accompanying drawings, wherein.

DETAILED DESCRIPTION

Figure 1:
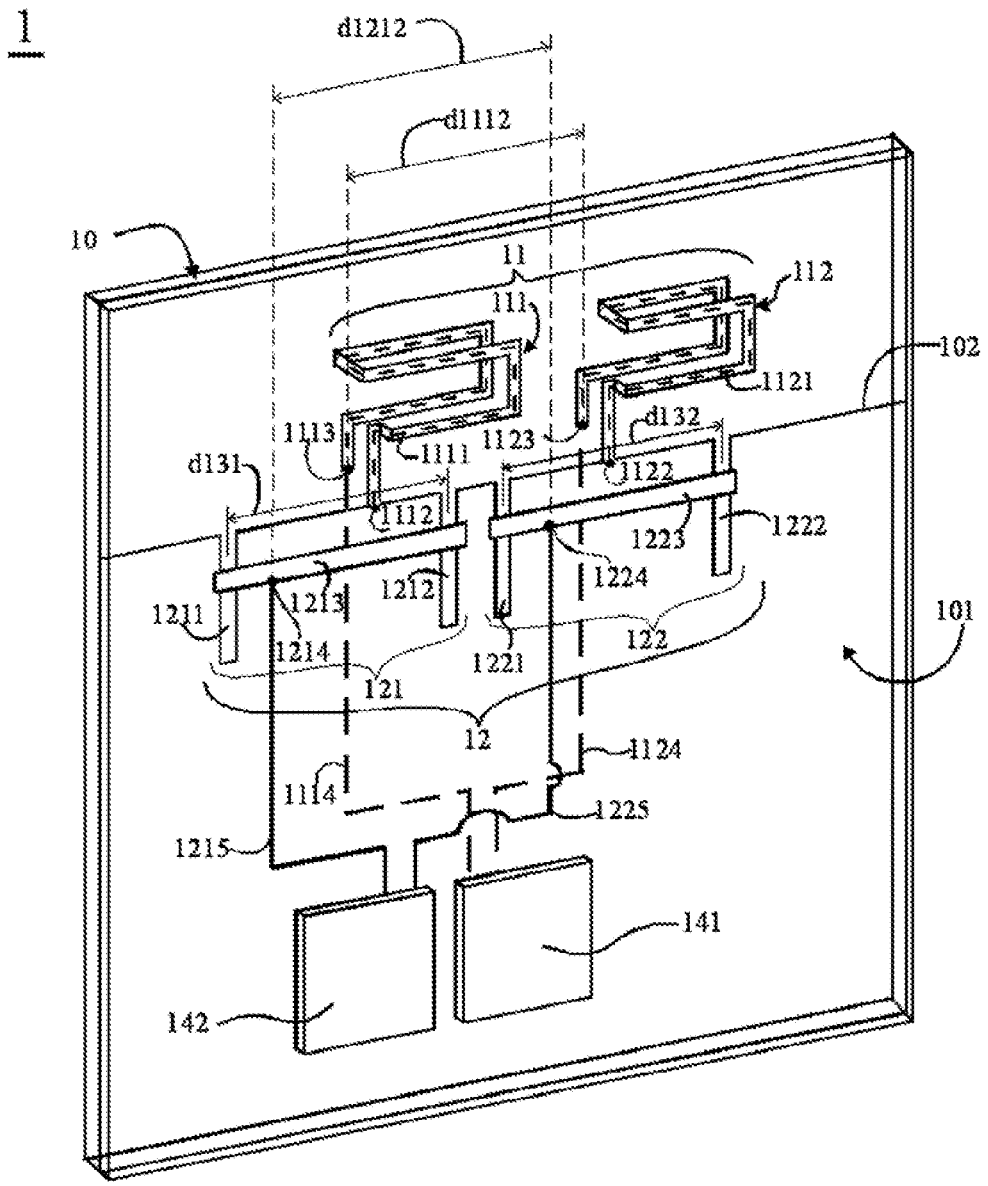
FIG. 1 is a structural diagram of a hybrid multi-band antenna array 1 of an embodiment according to this disclosure.

In the following detailed description, for purposes of explanation, numerous specific details are set forth in order to provide a thorough understanding of the disclosed embodiments.

This disclosure provides an exemplary embodiment of a hybrid multi-band antenna array. The hybrid multi-band antenna array comprises a multilayer substrate board, a first antenna array and a second antenna array. The multilayer substrate board includes a ground conductor structure having a first edge. The first antenna array includes a plurality of folded loop antennas. The plurality of folded loop antennas are integrated with the multilayer substrate board and arranged along the first edge sequentially. The folded loop antennas include their respective meandered metal resonant paths. The meandered metal resonant paths have their respective loop shorting point and loop feeding points. Each of the loop shorting points is electrically connected to the ground conductor structure, two neighboring ones of the loop feeding points are respectively spaced apart at a first interval, and the first antenna array is excited to generate a first resonant mode covering at least one first communication band. The second antenna array includes a plurality of parallel-connected slot antennas. All of the parallel-connected slot antennas are integrated with the multilayer substrate board and arranged along the first edge sequentially. Each of the parallel-connected slot antennas includes a first slot, a second slot and a signal coupling line extending across the first slot and the second slot. All of the first slots and all of the second slots are disposed on the ground conductor structure. Each of the signal coupling lines has a slot feeding point, and any two neighboring ones of the slot feeding points are respectively spaced apart at a second interval. The second antenna array is excited to generate a second resonant mode covering at least one second communication band, and the frequency of the second resonant mode is lower than the frequency of the first resonant mode.

In order that the requirements of minimization, high integration and multi-band operation could be achieved, this disclosure provides the hybrid multi-band antenna array, in which the first antenna array is excited to generate a first resonant mode that covers at least one first communication band, the second antenna array is excited to generate a second resonant mode that covers at least one second communication band, and the frequency of the second resonant mode is lower than the frequency of the first resonant mode. In the hybrid multi-band antenna array according to this disclosure, the first intervals are between 0.23 wavelength and 0.85 wavelength of the lowest operating frequency of the first communication band, and the second intervals are between 0.23 wavelength and 0.85 wavelength of the lowest operating frequency of the second communication band. Therefore, coupling interference of the far-field radiation energy of the first antenna array and the second antenna array could be reduced effectively. In the hybrid multi-band antenna array according to this disclosure, the central point positions of the openings of the first slots and the central point positions of the openings of the second slots of the parallel-connected slot antennas are spaced apart at third intervals, the third intervals are between 0.1 wavelength and 0.7 wavelength of the lowest operating frequency of the second communication band, and path lengths of the plurality of meandered metal resonant paths from the loop feeding points to the loop shorting points are between 0.5 wavelength and 2.0 wavelength of the lowest operating frequency of the first communication band. Therefore, coupling interference of the near-field radiation energy of the first antenna array and the second antenna array could be reduced effectively. This makes the destructive interference on the multibeam radiation patterns of the first antenna array and the second antenna array to be reduced successfully, and the requirements of compact size, high integration and multi-band operation to be achieved successfully.

FIG. 1 is a structural diagram of a hybrid multi-band antenna array 1 of an embodiment according to this disclosure. The hybrid multi-band antenna array 1 comprises a multilayer substrate board 10, a first antenna array 11 and a second antenna array 12. The multilayer substrate board 10 includes a ground conductor structure 101 having a first edge 102. The first antenna array 11 includes a plurality of folded loop antennas 111 and 112. The plurality of folded loop antennas 111 and 112 are integrated with the multilayer substrate board 10, and arranged along the first edge 102 sequentially. The folded loop antennas 111 and 112 include their respective meandered metal resonant paths 1111 and 1121, each of the meandered metal resonant paths 1111 and 1121 has loop shorting points 1112 and 1122 and loop feeding points 1113 and 1123. Each of the loop shorting points 1112 and 1122 are electrically connected to the ground conductor structure 101. The loop feeding points 1113 and 1123 are respectively spaced apart at a first interval d1112. The first antenna array 11 excites a first resonant mode that covers at least one first communication band. The second antenna array 12 comprises a plurality of parallel-connected slot antennas 121 and 122. The plurality of parallel-connected slot antennas 121 and 122 are integrated with the multilayer substrate board 10, and arranged along the first edge 102 sequentially. Each of the parallel-connected slot antennas 121 and 122 have their respective first slots 1211 and 1221, second slots 1212 and 1222 and signal coupling lines 1213 and 1223 extending across the first slots 1211 and 1221 and the second slots 1212 and 1222, respectively. The plurality of first slots 1211 and 1221 and the plurality of second slots 1212 and 1222 are disposed on the ground conductor structure 101. The plurality of signal coupling lines 1213 and 1223 have their respective slot feeding points 1214 and 1224 that are spaced apart at a second interval d1212. The second antenna array 12 is excited to generate a second resonant mode that covers at least one second communication band, and the frequency of the second resonant mode is lower than the frequency of the first resonant mode. The ground conductor structure 101 is a ground conductor plane. The first interval d1112 is between 0.23 wavelength and 0.85 wavelength of the lowest operating frequency of the first communication band. The second interval d1212 is between 0.23 wavelength and 0.85 wavelength of the lowest operating frequency of the second communication band. The central point positions of the openings of the first slots 1211 and 1221 of the plurality of parallel-connected slot antennas 121 and 122 are spaced apart from the central point positions of the openings of the second slots 1212 and 1222 at third intervals d131 and d132, respectively, which are between 0.1 wavelength and 0.7 wavelength of the lowest operating frequency of the second communication band. Path lengths of the plurality of meandered metal resonant paths 1111 and 1121 from the loop feeding points 1113 and 1123 to the loop shorting points 1112 and 1122 are between 0.5 wavelength and 2.0 wavelength of the lowest operating frequency of the first communication band. Path widths of the plurality of meandered metal resonant paths 1111 and 1121 are less than or equal to 0.25 wavelength of the lowest operating frequency of the first communication band. Slot lengths from opening ends to closing ends of the plurality of first slots 1211 and 1221 and the plurality of second slots 1212 and 1222 are less than or equal to 0.6 wavelength of the lowest operating frequency of the second communication band. Slot widths of the plurality of first slots 1211 and 1221 and the plurality of second slots 1212 and 1222 are less than or equal to 0.2 wavelength of the lowest operating frequency of the second communication band.

The loop feeding points 1113 and 1123 are electrically coupled through transmission lines 1114 and 1124, respectively, to a first beamforming circuit 141. The slot feeding points 1214 and 1224 are electrically coupled through transmission lines 1215 and 1225, respectively, to a second beamforming circuit 142. The transmission lines 1114 and 1124 and the transmission lines 1215 and 1225 could be a microstrip transmission line architecture, a sandwiched strip line architecture, a co-axial transmission line architecture, a co-planar waveguide transmission line architecture, a ground co-planar waveguide transmission line architecture, a combination thereof, or an improved architecture. The first beamforming circuit 141 excites the first antenna array 11 to generate the first resonant mode, and could generate signals with different phases, allowing the first antenna array 11 to generate different radiation patterns. The second beamforming circuit 142 excites the second antenna array 12 to generate the second resonant mode, and could generate signals with different phases, allowing the second antenna array 12 to generate different radiation patterns. The first beamforming circuit 141 and the second beamforming circuit 142 could be a power combining circuit, a phase controlling circuit, a frequency up-down-conversion circuit, an impedance matching circuit, an amplifier circuit, an integrated circuit chip or a radio frequency module.

In order to meet the requirements of compact size, high integration and multi-band operation, this disclosure provides the hybrid multi-band antenna array 1, in which the first antenna array 11 is excited to generate a first resonant mode that covers at least one first communication band, the second antenna array 12 is excited to generate a second resonant mode that covers at least one second communication band, and the frequency of the second resonant mode is lower than the frequency of the first resonant mode. In the hybrid multi-band antenna array 1 according to this disclosure, the first interval d1112 is between 0.23 wavelength and 0.85 wavelength of the lowest operating frequency of the first communication band, and the second interval d1212 is between 0.23 wavelength and 0.85 wavelength of the of the lowest operating frequency of the second communication band. Therefore, the coupling interference of far-field radiation energy of the first antenna array 11 and the second antenna array 12 could be effectively reduced. In addition, in the hybrid multi-band antenna array 1 according to this disclosure, central point positions of the openings of the first slots 1211 and 1221 of the plurality of parallel-connected slot antennas 121 and 122 are spaced apart from central point positions of the openings of the second slots 1212 and 1222 at third intervals d131 and d132, respectively. In the hybrid multi-band antenna array 1 according to this disclosure, the third intervals d131 and d132 are between 0.1 wavelength and 0.7 wavelength of the lowest operating frequency of the second communication band, and the path lengths of the plurality of meandered metal resonant paths 1111 and 1121 from the loop feeding points 1113 and 1123 to the loop shorting points 1112 and 1122 are between 0.5 wavelength and 2.0 wavelength of the lowest operating frequency of the first communication band. Therefore, the coupling interference of near-field radiation energy of the first antenna array 11 and the second antenna array 12 could be reduced effectively. This makes the destructive interference on the multibeam radiation patterns of the first antenna array 11 and the second antenna array 12 could also be reduced successfully. Hence, the requirements of compact size, high integration and multi-band operation could be achieved successfully. The hybrid multi-band antenna array 1 according to this disclosure could be singly or in plural realized in a communication device. The communication device could be a mobile communication device, a wireless communication device, a mobile operating device, a computer system, telecom equipment, base station equipment, network equipment, or peripheral equipment, such as a computer and a network.

Figure 2A:
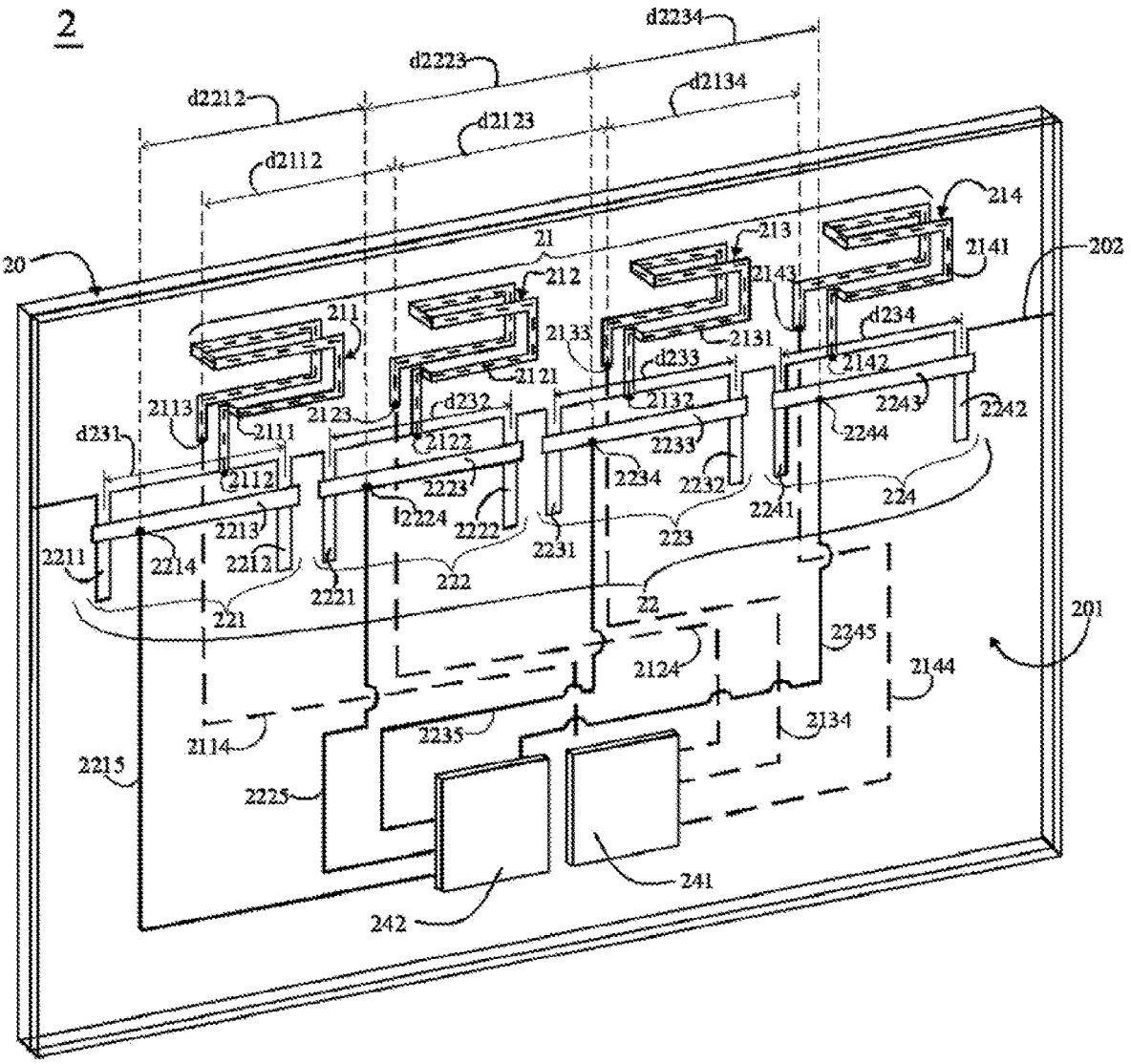
FIG. 2A is a structural diagram of a hybrid multi-band antenna array 2 of an embodiment according to this disclosure.
Figure 2B:
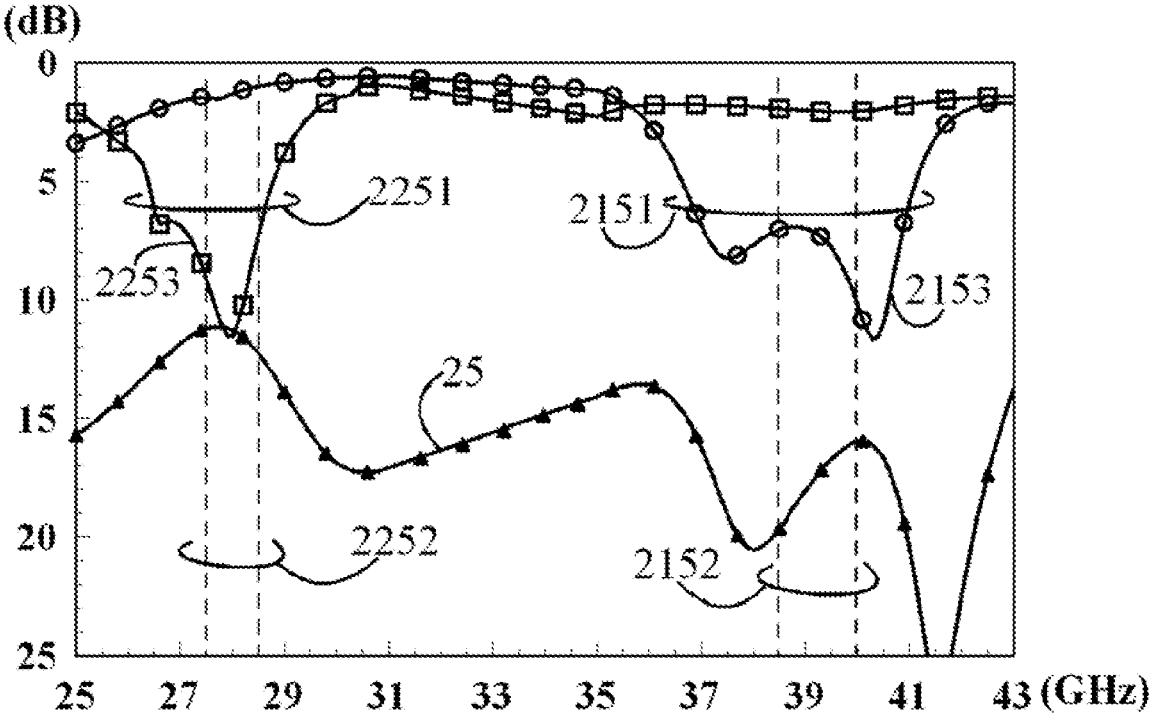
FIG. 2B is return loss and isolation curve diagrams of a hybrid multi-band antenna array 2 of an embodiment according to this disclosure.

FIG. 2A is a structural diagram of a hybrid multi-band antenna array 2 of an embodiment according to this disclosure. FIG. 2B is return loss and isolation curve diagrams of a hybrid multi-band antenna array 2 of an embodiment according to this disclosure. The hybrid multi-band antenna array 2 comprises a multilayer substrate board 20, a first antenna array 21 and a second antenna array 22. The multilayer substrate board 20 includes a ground conductor structure 201 having a first edge 202. The first antenna array 21 includes a plurality of folded loop antennas 211, 212, 213 and 214. The plurality of folded loop antennas 211, 212, 213 and 214 are integrated with the multilayer substrate board 20, and arranged along the first edge 202 sequentially. The folded loop antennas 211, 212, 213 and 214 include their respective meandered metal resonant paths 2111, 2121, 2131 and 2141 that have their respective loop shorting points 2112, 2122, 2132 and 2142 and loop feeding points 2113, 2123, 2133 and 2143. Each of the loop shorting points 2112, 2122, 2132 and 2142 are electrically connected to the ground conductor structure 201. The loop feeding points 2113, 2123, 2133 and 2143 are spaced apart at first intervals d2112, d2123 and d2134, respectively. The first antenna array 21 is excited to generate a first resonant mode 2151 that covers at least one first communication band 2152 (as shown in FIG. 2B). The second antenna array 22 includes a plurality of parallel-connected slot antennas 221, 222, 223 and 224. The plurality of parallel-connected slot antennas 221, 222, 223 and 224 are integrated with the multilayer substrate board 20, and arranged along the first edge 202 sequentially. The parallel-connected slot antennas 221, 222, 223 and 224 have their respective first slots 2211, 2221, 2231 and 2241, second slots 2212, 2222, 2232 and 2242, and signal coupling lines 2213, 2223, 2233 and 2243 extending across the first slots 2211, 2221, 2231 and 2241 and the second slots 2212, 2222, 2232 and 2242, respectively. The plurality of first slots 2211, 2221, 2231 and 2241 and the plurality of second slots 2212, 2222, 2232 and 2242 are disposed on the ground conductor structure 201. The plurality of signal coupling lines 2213, 2223, 2233 and 2243 include their respective slot feeding points 2214, 2224, 2234 and 2244 that are spaced apart at second intervals d2212, d2223 and d2234, respectively. The second antenna array 22 is excited to generate a second resonant mode 2251 that covers at least one second communication band 2252. The frequency of the second resonant mode 2251 is lower than the frequency of the first resonant mode 2151 (as shown in FIG. 2B). The ground conductor structure 201 is a ground conductor plane. The first intervals d2112, d2123 and d2134 are between 0.23 wavelength and 0.85 wavelength of the lowest operating frequency of the first communication band 2152. The second intervals d2212, d2223 and d2234 are between 0.23 wavelength and 0.85 wavelength of the lowest operating frequency of the second communication band 2252. The central point positions of the openings of the first slots 2211, 2221, 2231 and 2241 of the plurality of parallel-connected slot antennas 221, 222, 223 and 224 are spaced apart from the central point positions of the openings of the second slots 2212, 2222, 2232 and 2242 at third intervals d231, d232, d233 and d234, respectively. The third intervals d231, d232, d233 and d234 are between 0.1 wavelength and 0.7 wavelength of the lowest operating frequency of the second communication band 2252. Path lengths of the plurality of meandered metal resonant paths 2111, 2121, 2131 and 2141 from the loop feeding points 2113, 2123, 2133 and 2143 to the loop shorting points 2112, 2122, 2132 and 2142 are between 0.5 wavelength and 2.0 wavelength of the lowest operating frequency of the first communication band 2152. The path widths of the plurality of meandered metal resonant paths 2111, 2121, 2131 and 2141 are less than or equal to 0.25 wavelength of the lowest operating frequency of the first communication band 2152. Slot lengths from opening ends to closing ends of the plurality of first slots 2211, 2221, 2231 and 2241 and the plurality of second slots 2212, 2222, 2232 and 2242 are less than or equal to 0.6 wavelength of the lowest operating frequency of the second communication band 2252. Slot widths of the plurality of first slots 2211, 2221, 2231 and 2241 and the plurality of second slots 2212, 2222, 2232 and 2242 are less than or equal to 0.2 wavelength of the lowest operating frequency of the second communication band 2252.

Figure 2C:
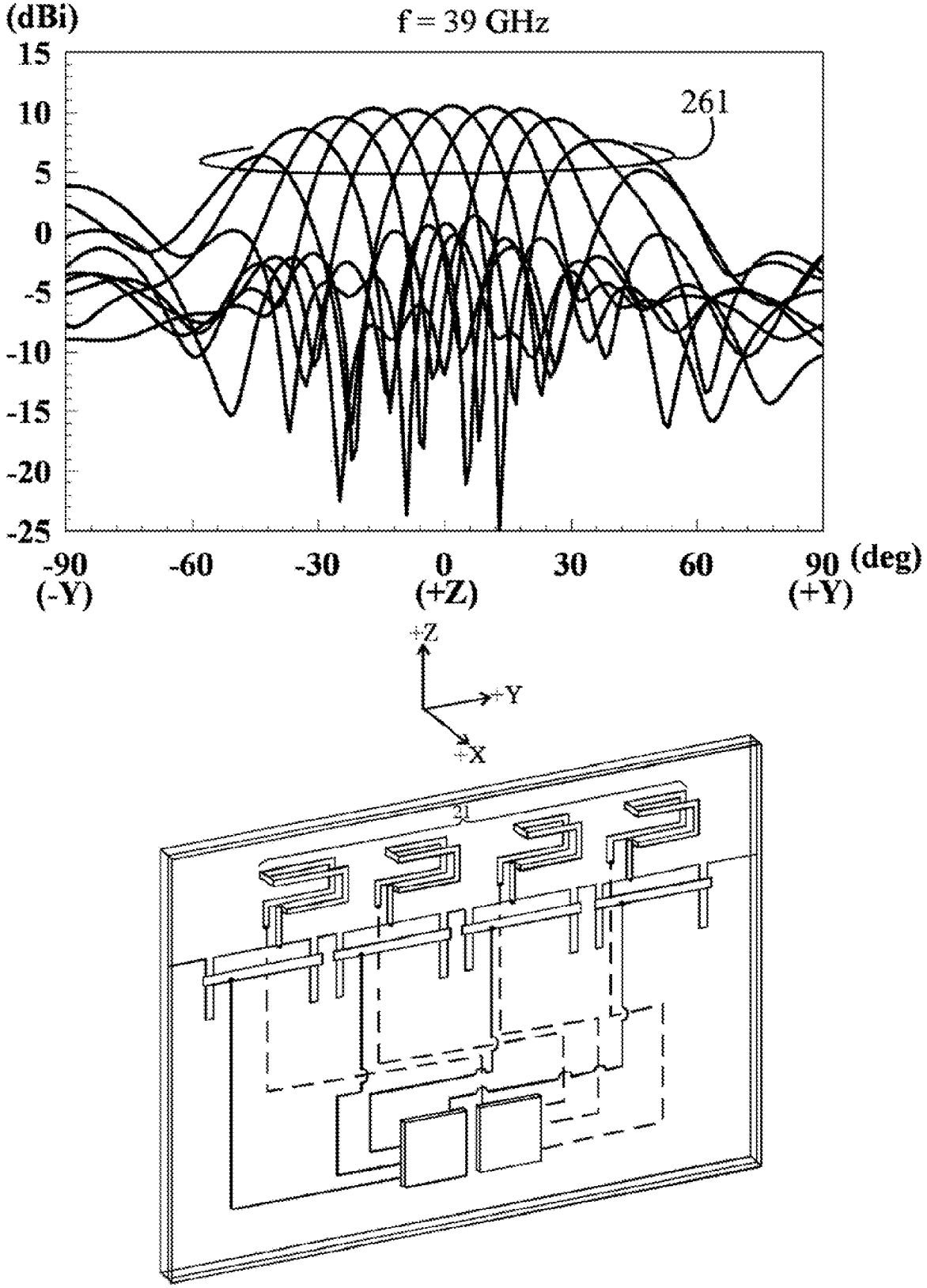
FIG. 2C is a multibeam scanning 2D radiation pattern diagram of a first antenna array 21 of a hybrid multi-band antenna array 2 in a first communication band of an embodiment according to this disclosure.
Figure 2D:
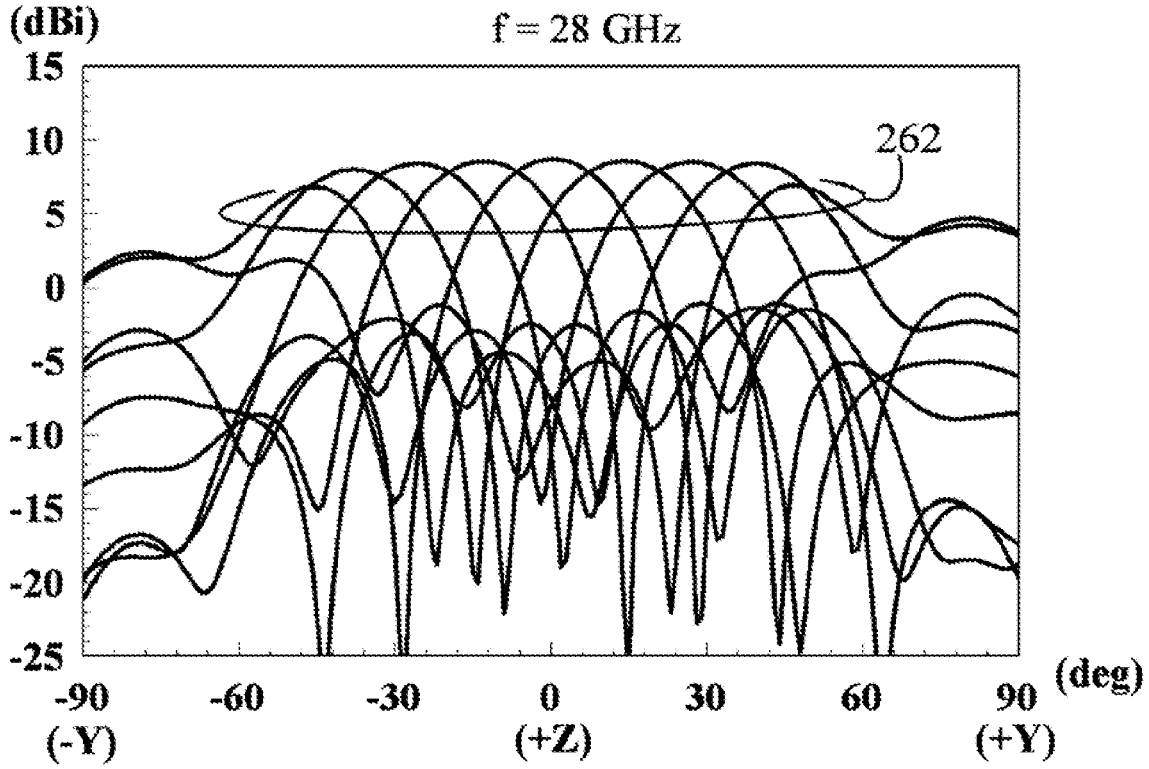
FIG. 2D is a multibeam scanning 2D radiation pattern diagram of a second antenna array 22 of a hybrid multi-band antenna array 2 in a second communication band of an embodiment according to this disclosure.
Figure 2D:
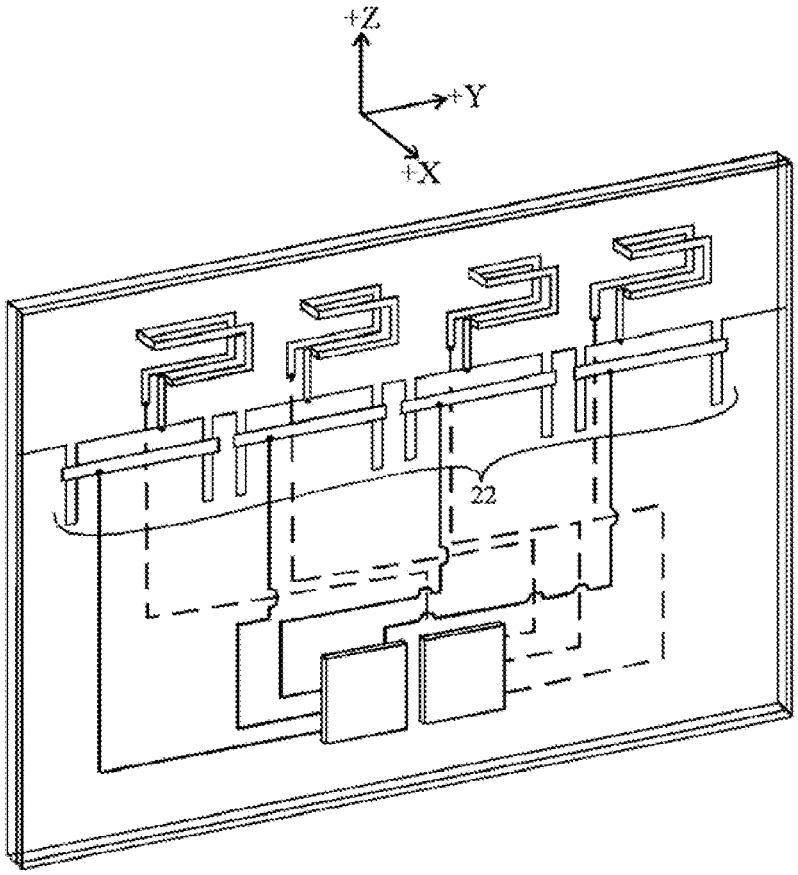

The loop feeding points 2113, 2123, 2133 and 2143 are electrically coupled to a first beamforming circuit 241 through first antenna array transmission lines 2114, 2124, 2134 and 2144, respectively. The slot feeding points 2214, 2224, 2234 and 2244 are electrically coupled through second antenna array transmission lines 2215, 2225, 2235 and 2245, respectively, to a second beamforming circuit 242. The first antenna array transmission lines 2114, 2124, 2134 and 2144 and the second antenna array transmission lines 2215, 2225, 2235 and 2245 could be a microstrip transmission line architecture, a strip line architecture, a co-axial transmission line architecture, a co-planar waveguide transmission line architecture, a grounded co-planar waveguide transmission line architecture, a combination thereof, or an improved architecture. The first beamforming circuit 241 excites the first antenna array 21 to generate the first resonant mode 2151. The first beamforming circuit 241 could generate signals with different phases, allowing the first antenna array 21 to generate different radiation patterns (as shown in FIG. 2C). The second beamforming circuit 242 excites the second antenna array 22 to generate the second resonant mode 2251. The second beamforming circuit 242 could generate signals with different phases, allowing the second antenna array 22 to generate different radiation patterns (as shown in FIG. 2D). The first beamforming circuit 241 and the second beamforming circuit 242 could be a power combining circuit, a phase controlling circuit, a frequency up-down-conversion circuit, an impedance matching circuit, an amplifier circuit, an integrated circuit chip or a radio frequency module.

In order to achieve the requirements of compact size, high integration and multi frequency band operation successfully, this disclosure provides the hybrid multi-band antenna array 2, in which the first antenna array 21 is excited to generate a first resonant mode 2151 that covers at least one first communication band 2152, the second antenna array 22 is excited to generate a second resonant mode 2251 that covers at least one second communication band 2252, and the frequency of the second resonant mode 2251 is lower than the frequency of the first resonant mode 2151 (as shown in FIG. 2B). In the hybrid multi-band antenna array 2 according to this disclosure, the first intervals d2112, d2123 and d2134 are between 0.23 wavelength and 0.85 wavelength of the lowest operating frequency of the first communication band 2152, and the second intervals d2212, d2223 and d2234 are between 0.23 wavelength and 0.85 wavelength of the lowest operating frequency of the second communication band 2252. Therefore, the coupling interference of far-field radiation energy of the first antenna array 21 and the second antenna array 22 could be reduced effectively. In addition, in the hybrid multi-band antenna array 2 according to this disclosure, the central point positions of the openings of the first slots 2211, 2221, 2231 and 2241 of the plurality of parallel-connected slot antennas 221, 222, 223 and 224 are spaced apart at third intervals d231, d232, d233 and d234, respectively. In the hybrid multi-band antenna array 2 according to this disclosure, the third intervals d231, d232, d233 and d234 are between 0.1 wavelength and 0.7 wavelength of the lowest operating frequency of the second communication band 2252, and path lengths of the plurality of meandered metal resonant paths 2111, 2121, 2131 and 2141 from the loop feeding points 2113, 2123, 2133 and 2143 to the loop shorting points 2112, 2122, 2132 and 2142 are between 0.5 wavelength and 2.0 wavelength of the lowest operating frequency of the first communication band 2152. Therefore, the coupling interference of near-field radiation energy of the first antenna array 21 and the second antenna array 22 could be reduced effectively. This makes destructive interference on the multibeam radiation patterns of the first antenna array 21 and the second antenna array 22 to be reduced successfully. The requirements of minimization, high integration and multi frequency band operation could thus be achieved successfully.

FIG. 2B is return loss and isolation curve diagrams of a hybrid multi-band antenna array 2 of an embodiment according to this disclosure. The first antenna array 21 has a return loss curve 2153. The second antenna array 22 has a return loss curve 2253. The first antenna array 21 and the second antenna array 22 have isolation curves 25. In experiments, the first edge 202 of the ground conductor plane 201 is about 60 mm long, a path length of the meandered metal resonant path 2111 from the loop feeding point 2113 to the loop shorting point 2112 is about 13.2 mm, a path length of the meandered metal resonant path 2121 from the loop feeding point 2123 to the loop shorting point 2122 is about 13.5 mm, a path length of the meandered metal resonant path 2131 from the loop feeding point 2133 to the loop shorting point 2132 is about 13.5 mm, a path length of the meandered metal resonant path 2141 from the loop feeding point 2143 to the loop shorting point 2142 is about 13.2 mm, the first interval d2112 is about 4 mm, the first interval d2123 is about 4.3 mm, the first interval d2134 is about 4 mm, the second interval d2212 is about 5.1 mm, the second interval d2223 is about 5.3 mm, the second interval d2234 is about 5.1 mm, the third interval d231 is about 4.25 mm, the third interval d232 is about 4 mm, the third interval d233 is about 4 mm, the third interval d234 is about 4.25 mm, the multilayer substrate board 20 is a two-layered medium substrate being about 0.6 mm in a total thickness, and a dielectric constant of a medium substrate is about 3.5. As shown in FIG. 2B, the first antenna array 21 is excited to generate a first resonant mode 2151 that covers at least one first communication band 2152. As shown in FIG. 2B, the second antenna array 22 is excited to generate a second resonant mode 2251 that covers at least one second communication band 2252. The frequency of the second resonant mode 2251 is lower than the frequency of the first resonant mode 2151. In an embodiment, the first resonant mode 2151 covers at least one first communication band 2152 (38.5 GHz-40 GHz), the second resonant mode 2251 covers at least one second communication band 2252 (27.5 GHz-28.5 GHz), and the frequency of the second resonant mode 2251 is lower than the frequency of the first resonant mode 2151. The lowest operating frequency of the first communication band 2152 is about 38.5 GHz, and the lowest operating frequency of the second communication band 2252 is about 27.5 GHz. As shown in FIG. 2B, the isolation curves 25 of the first antenna array 21 and second antenna array 22 are greater than 15 dB in the first communication band 2152, and are greater than 10 dB in the second communication band 2252, which prove well enough for isolation performance.

FIG. 2C is a multibeam scanning 2D radiation pattern diagram of the first antenna array 21 of the hybrid multi-band antenna array 2 in a first communication band of an embodiment according to this disclosure. FIG. 2D is a multibeam scanning 2D radiation pattern diagram of the second antenna array 22 of the hybrid multi-band antenna array 2 in a second communication band of an embodiment according to this disclosure. It can be clearly seen from the variation curve 261 of multibeam 2D radiation patterns of the first antenna array 21 of FIG. 2C and the variation curve 262 of multibeam 2D radiation patterns of the second antenna array 22 of FIG. 2D that far-field main radiation beams of the first antenna array 21 and the second antenna array 22 in different frequency bands could coexist and cooperate, and will not be destructed or offset by each other, which proves that the multi-band wireless communication transmission could be achieved successfully.

The communication band operations, the experimental data, the number of layers of the medium substrate board, and the number of layers of the ground conductor plane covers in FIGS. 2B-2D are proposed to prove the technical effect of the hybrid multi-band antenna array 2 of an embodiment according to this disclosure of FIG. 2A, and are not used to limit the communication band operations, applications and specification encompassed in practical applications of the hybrid multi-band antenna array 2 according to this disclosure. The hybrid multi-band antenna array 2 according to this disclosure could be singly or in plural realized in a communication device that could be a mobile communication device, a wireless communication device, a mobile operating device, a computer system, telecom equipment, base station equipment, network equipment, or peripheral equipment, such as a computer and a network.

Figure 3:
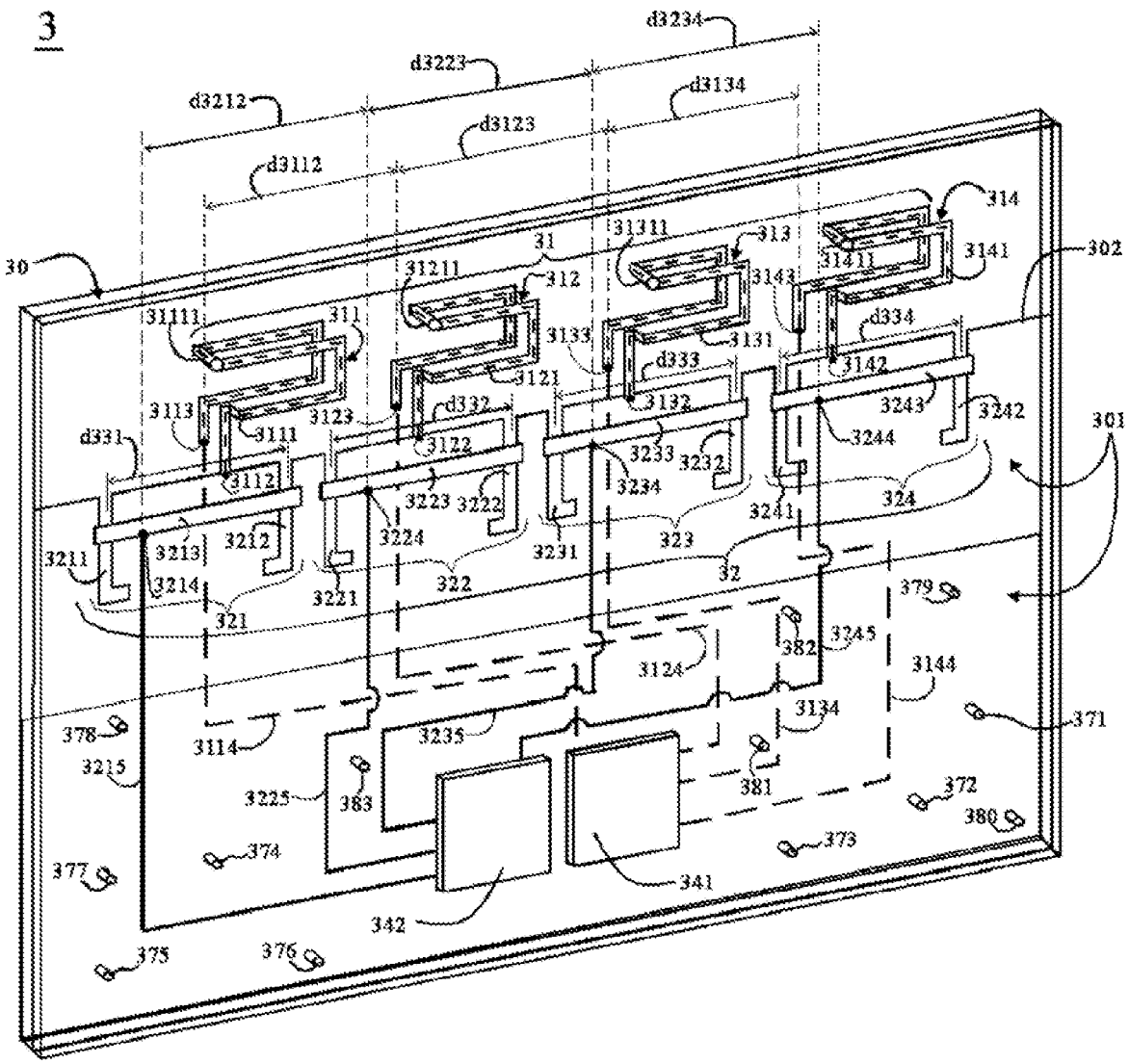
FIG. 3 is a structural diagram of a hybrid multi-band antenna array 3 of an embodiment according to this disclosure.

FIG. 3 is a structural diagram of a hybrid multi-band antenna array 3 of an embodiment according to this disclosure. The hybrid multi-band antenna array 3 comprises a multilayer substrate board 30, a first antenna array 31 and a second antenna array 32. The multilayer substrate board 30 includes a ground conductor structure 301 having a first edge 302. The ground conductor structure 301 is a multilayer ground conductor plane electrically connected to one another through a plurality of ground conducting vias 371, 372, 373, 374, 375, 376, 377, 378, 379, 380, 381, 382 and 383. The first antenna array 31 includes a plurality of folded loop antennas 311, 312, 313 and 314. The plurality of folded loop antennas 311, 312, 313 and 314 are integrated with the multilayer substrate board 30, and arranged along the first edge 302 sequentially. The folded loop antennas 311, 312, 313 and 314 include their respective meandered metal resonant paths 3111, 3121, 3131 and 3141. A portion of metal resonance paths of each of the meandered metal resonant paths 3111, 3121, 3131 and 3141 are realized by conductor vias 31111, 31211, 31311 and 31411. Each of the meandered metal resonant paths 3111, 3121, 3131 and 3141 include their respective loop shorting points 3112, 3122, 3132 and 3142 and loop feeding points 3113, 3123, 3133 and 3143. Each of the loop shorting points 3112, 3122, 3132 and 3142 are electrically connected to the ground conductor structure 301. The loop feeding points 3113, 3123, 3133 and 3143 are spaced apart at first intervals d3112, d3123 and d3134, respectively. The first antenna array 31 is excited to generate a first resonant mode that covers at least one first communication band. The second antenna array 32 includes a plurality of parallel-connected slot antennas 321, 322, 323 and 324. The plurality of parallel-connected slot antennas 321, 322, 323 and 324 are integrated with the multilayer substrate board 30, and arranged along the first edge 302 sequentially. The parallel-connected slot antennas 321, 322, 323 and 324 include their respective first slots 3211, 3221, 3231 and 3241, second slots 3212, 3222, 3232 and 3242, and signal coupling lines 3213, 3223, 3233 and 3243 extending across the first slots 3211, 3221, 3231 and 3241 and the second slots 3212, 3222, 3232 and 3242, respectively. The plurality of first slots 3211, 3221, 3231 and 3241 and the plurality of second slots 3212, 3222, 3232 and 3242 are disposed on the ground conductor structure 301. The plurality of signal coupling lines 3213, 3223, 3233 and 3243 include their respective slot feeding points 3214, 3224, 3234 and 3244. The slot feeding points 3214, 3224, 3234 and 3244 are spaced apart at second intervals d3212, d3223 and d3234, respectively. The second antenna array 32 is excited to generate a second resonant mode that covers at least one second communication band. The frequency of the second resonant mode is lower than the frequency of the first resonant mode. The first intervals d3112, d3123 and d3134 are between 0.23 wavelength and 0.85 wavelength of the lowest operating frequency of the first communication band. The second intervals d3212, d3223 and d3234 are between 0.23 wavelength and 0.85 wavelength of the lowest operating frequency of the second communication band. The central point positions of the openings of the first slots 3211, 3221, 3231 and 3241 of the plurality of parallel-connected slot antennas 321, 322, 323 and 324 and the central point positions of the openings of the second slots 3212, 3222, 3232 and 3242 are spaced apart at third intervals d331, d332, d333 and d334, respectively. The third intervals d331, d332, d333 and d334 are between 0.1 wavelength and 0.7 wavelength of the lowest operating frequency of the second communication band. Path lengths of the plurality of meandered metal resonant paths 3111, 3121, 3131 and 3141 from the loop feeding points 3113, 3123, 3133 and 3143 to the loop shorting points 3112, 3122, 3132 and 3142 are between 0.5 wavelength and 2.0 wavelength of the lowest operating frequency of the first communication band. The path widths of the plurality of meandered metal resonant paths 3111, 3121, 3131 and 3141 are less than or equal to 0.25 wavelength of the lowest operating frequency of the first communication band. Slot lengths from opening ends to closing ends of the plurality of first slots 3211, 3221, 3231 and 3241 and the plurality of second slots 3212, 3222, 3232 and 3242 are less than or equal to 0.6 wavelength of the lowest operating frequency of the second communication band. Slot widths of the plurality of first slots 3211, 3221, 3231 and 3241 and the plurality of second slots 3212, 3222, 3232 and 3242 are less than or equal to 0.2 wavelength of the lowest operating frequency of the second communication band. The loop feeding points 3113, 3123, 3133 and 3143 are electrically coupled through their respective first antenna array transmission lines 3114, 3124, 3134 and 3144 to a first beamforming circuit 341. The slot feeding points 3214, 3224, 3234 and 3244 are electrically coupled through their respective second antenna array transmission lines 3215, 3225, 3235 and 3245 to a second beamforming circuit 342. The first antenna array transmission lines 3114, 3124, 3134 and 3144 and the second antenna array transmission lines 3215, 3225, 3235 and 3245 could be a microstrip transmission line architecture, a strip line architecture, a co-axial transmission line architecture, a co-planar waveguide transmission line architecture, a grounded co-planar waveguide transmission line architecture, a combination thereof, or an improved architecture. The first beamforming circuit 341 excites the first antenna array 31 to generate the first resonant mode. The first beamforming circuit 341 could generate signals with different phases, allowing the first antenna array 31 to generate different radiation patterns. The second beamforming circuit 342 excites the second antenna array 32 to generate the second resonant mode. The second beamforming circuit 342 could generate signals with different phases, allowing the second antenna array 32 to generate different radiation patterns. The first beamforming circuit 341 and the second beamforming circuit 342 could be a power combining circuit, a phase controlling circuit, a frequency up-down-conversion circuit, an impedance matching circuit, an amplifier circuit, an integrated circuit chip or a radio frequency module.

FIG. 3 discloses the hybrid multi-band antenna array 3 of an embodiment. The ground conductor structure 301 of the hybrid multi-band antenna array 3 is a multi-layer ground conductor plane, which is not exactly the same as the ground conductor structure 201 of the hybrid multi-band antenna array 2. Each of the meandered metal resonant paths 3111, 3121, 3131 and 3141 of the hybrid multi-band antenna array 3 have a portion of the metal resonance paths being realized by conductor vias 31111, 31211, 31311 and 31411, and are also not exactly the same as the meandered metal resonant paths 2111, 2121, 2131 and 2141 of the hybrid multi-band antenna array 2. The shapes of the first slots 3211, 3221, 3231 and 3241 and the second slots 3212, 3222, 3232 and 3242 of the hybrid multi-band antenna array 3 and the shapes of the first slots 2211, 2221, 2231 and 2241 and the second slots 2212, 2222, 2232 and 2242 of the hybrid multi-band antenna array 2 are different slightly. However, in the hybrid multi-band antenna array 3 according to this disclosure, the first antenna array 31 is also excited to generate a first resonant mode that covers at least one first communication band, the second antenna array 32 is also excited to generate a second resonant mode that covers at least one second communication band, the frequency of the second resonant mode is also lower than the frequency of the first resonant mode. The first intervals d3112, d3123 and d3134 are also between 0.23 wavelength and 0.85 wavelength of the lowest operating frequency of the first communication band, and the second intervals d3212, d3223 and d3234 are also between 0.23 wavelength and 0.85 wavelength the of the lowest operating frequency of the second communication band. Therefore, the coupling interference of far-field radiation energy of the first antenna array 31 and the second antenna array 32 could be reduced effectively. In addition, in the hybrid multi-band antenna array according to this disclosure, the central point positions of the openings of the first slots 3211, 3221, 3231 and 3241 of the plurality of parallel-connected slot antennas 321, 322, 323 and 324 are spaced apart from the central point positions of the openings of the second slots 3212, 3222, 3232 and 3242 at third intervals d331, d332, d333 and d334, respectively. In the hybrid multi-band antenna array 3 according to this disclosure, the third intervals d331, d332, d333 and d334 are between 0.1 wavelength and 0.7 wavelength of the lowest operating frequency of the second communication band, and path lengths of the plurality of meandered metal resonant paths 3111, 3121, 3131 and 3141 from the loop feeding points 3113, 3123, 3133 and 3143 to the loop shorting points 3112, 3122, 3132 and 3142 are between 0.5 wavelength and 2.0 wavelength of the lowest operating frequency of the first communication band. Therefore, the coupling interference of near-field radiation energy of the first antenna array 31 and the second antenna array 32 could be reduced effectively. The hybrid multi-band antenna array 3 could achieve the same characteristics as the hybrid multi-band antenna array 2 does. The destructive interference of the multibeam radiation pattern of the first antenna array 31 and the second antenna array 32 could be reduced, and the requirements of minimization, high integration and multi-band operation could be met successfully. The hybrid multi-band antenna array 3 according to this disclosure could be singly or in plural realized in a communication device. The communication device could be a mobile communication device, a wireless communication device, a mobile operating device, a computer system, telecom equipment, base station equipment, network equipment, or peripheral equipment, such as a computer and a network.

Figure 4:
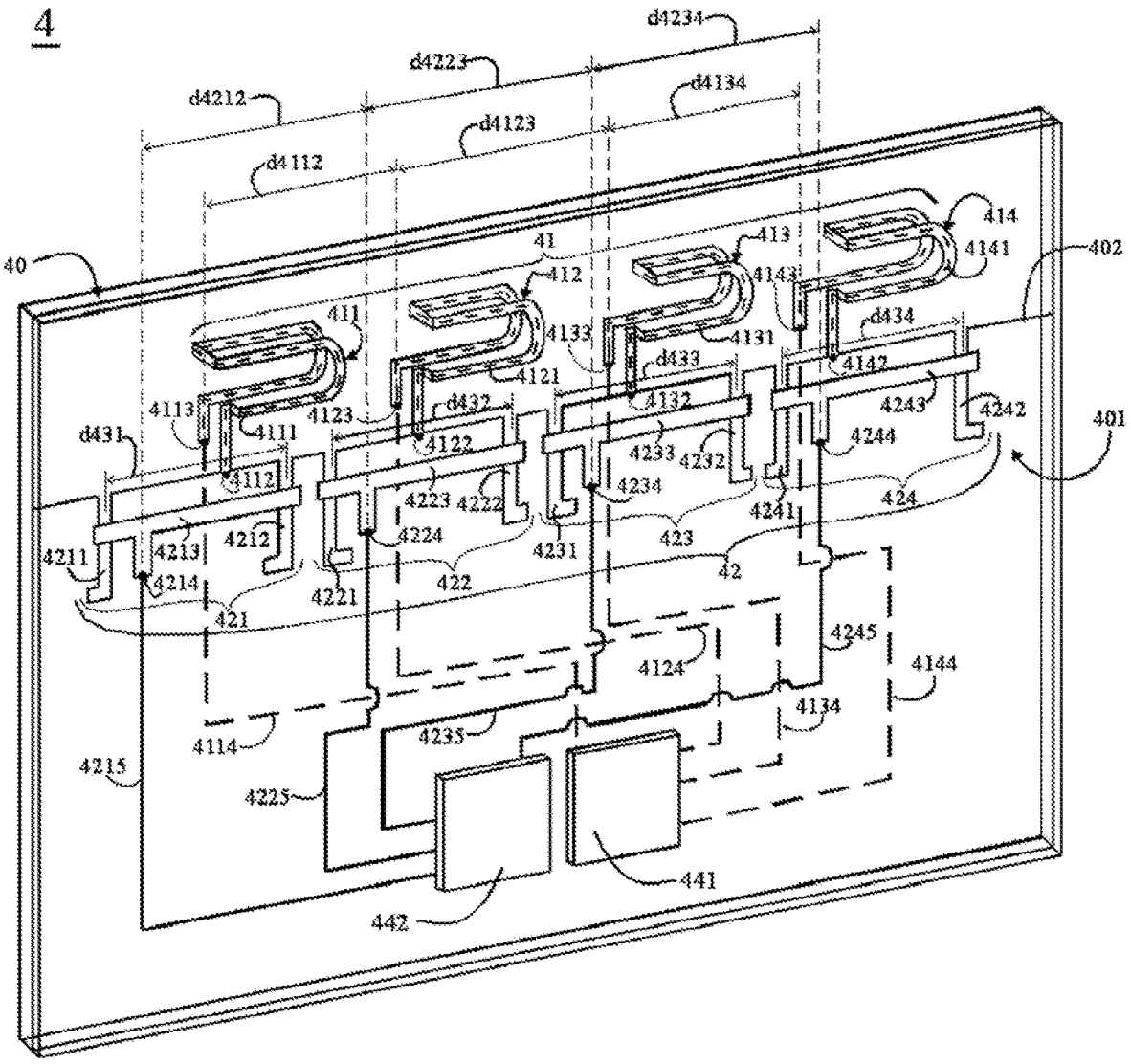
FIG. 4 is a structural diagram of a hybrid multi-band antenna array 4 of an embodiment according to this disclosure.

FIG. 4 is a structural diagram of a hybrid multi-band antenna array 4 of an embodiment according to this disclosure. As shown in FIG. 4, the hybrid multi-band antenna array 4 comprises a multilayer substrate board 40, a first antenna array 41 and a second antenna array 42. The multilayer substrate board 40 includes a ground conductor structure 401 having a first edge 402. The ground conductor structure 401 is a ground conductor plane. The first antenna array 41 includes a plurality of folded loop antennas 411, 412, 413 and 414. The plurality of folded loop antennas 411, 412, 413 and 414 are integrated with the multilayer substrate board 40, and arranged along the first edge 402 sequentially. The folded loop antennas 411, 412, 413 and 414 have their respective meandered metal resonant paths 4111, 4121, 4131 and 4141. The meandered metal resonant paths 4111, 4121, 4131 and 4141 have their respective loop shorting points 4112, 4122, 4132 and 4142 and loop feeding points 4113, 4123, 4133 and 4143. The loop shorting points 4112, 4122, 4132 and 4142 are electrically connected to the ground conductor structure 401. The loop feeding points 4113, 4123, 4133 and 4143 are spaced apart at first intervals d4112, d4123 and d4134, respectively. The first antenna array 41 is excited to generate a first resonant mode that covers at least one first communication band. The second antenna array 42 comprises a plurality of parallel-connected slot antennas 421, 422, 423 and 424. The plurality of parallel-connected slot antennas 421, 422, 423 and 424 are integrated with the multilayer substrate board 40, and arranged along the first edge 402 sequentially. The parallel-connected slot antennas 421, 422, 423 and 424 have their respective first slots 4211, 4221, 4231 and 4241, second slots 4212, 4222, 4232 and 4242, and signal coupling lines 4213, 4223, 4233 and 4243 extending across the first slots 4211, 4221, 4231 and 4241 and the second slots 4212, 4222, 4232 and 4242, respectively. The plurality of first slots 4211, 4221, 4231 and 4241 and the plurality of second slots 4212, 4222, 4232 and 4242 are disposed on the ground conductor structure 401. The plurality of signal coupling lines 4213, 4223, 4233 and 4243 have their respective slot feeding points 4214, 4224, 4234 and 4244. The slot feeding points 4214, 4224, 4234 and 4244 are spaced apart at second intervals d4212, d4223 and d4234, respectively. The second antenna array 42 is excited to generate a second resonant mode that covers at least one second communication band. The frequency of the second resonant mode is lower than the frequency of the first resonant mode. The first intervals d4112, d4123 and d4134 are between 0.23 wavelength and 0.85 wavelength of the lowest operating frequency of the first communication band. The second intervals d4212, d4223 and d4234 are between 0.23 wavelength and 0.85 wavelength of the lowest operating frequency of the second communication band. The central point positions of the openings of the first slot 4211、4221、4231、2241 of the plurality of parallel-connected slot antennas 421, 422, 423 and 424 are spaced apart from the central point positions of the openings of the second slots 4212, 4222, 4232 and 4242 at third intervals d431, d432, d433 and d434, respectively. The third intervals d431、d432、d433、d234 are between 0.1 wavelength and 0.7 wavelength of the lowest operating frequency of the second communication band. Path lengths of the plurality of meandered metal resonant paths 4111, 4121, 4131 and 4141 from the loop feeding points 4113, 4123, 4133 and 4143 to the loop shorting points 4112, 4122, 4132 and 4142 are between 0.5 wavelength and 2.0 wavelength of the lowest operating frequency of the first communication band. Path widths of the plurality of meandered metal resonant paths 4111, 4121, 4131 and 4141 are less than or equal to 0.25 wavelength of the lowest operating frequency of the first communication band. Slot lengths from opening ends to closing ends of the plurality of first slots 4211, 4221, 4231 and 4241 and the plurality of second slots 4212, 4222, 4232 and 4242 are less than or equal to 0.6 wavelength of the lowest operating frequency of the second communication band. Slot widths of the plurality of first slots 4211, 4221, 4231 and 4241 and the plurality of second slots 4212, 4222, 4232 and 4242 are less than or equal to 0.2 wavelength of the lowest operating frequency of the second communication band. The loop feeding points 4113, 4123, 4133 and 4143 are electrically coupled to a first beamforming circuit 441 through first antenna array transmission lines 4114, 4124, 4134 and 4144, respectively. The slot feeding points 4214, 4224, 4234 and 4244 are electrically coupled to a second beamforming circuit 442 through second antenna array transmission lines 4215, 4225, 4235 and 4245, respectively. The first antenna array transmission lines 4114, 4124, 4134 and 4144 and the second antenna array transmission lines 4215, 4225, 4235 and 4245 could be a microstrip transmission line architecture, a sandwiched strip line architecture, a co-axial transmission line architecture, a co-planar waveguide transmission line architecture, a grounded co-planar waveguide transmission line architecture, a combination thereof, or an improved architecture. The first beamforming circuit 441 excites the first antenna array 41 to generate the first resonant mode. The first beamforming circuit 441 could generate signals with different phases, allowing the first antenna array 41 to generate different radiation patterns. The second beamforming circuit 442 excites the second antenna array 42 to generate the second resonant mode. The second beamforming circuit 442 could generate signals with different phases, allowing the second antenna array 42 to generate different radiation patterns. The first beamforming circuit 441 and the second beamforming circuit 442 could be a power combining circuit, a phase controlling circuit, a frequency up-down-conversion circuit, an impedance matching circuit, an amplifier circuit, an integrated circuit chip or a radio frequency module.

FIG. 4 discloses the hybrid multi-band antenna array 4 of an embodiment according to this disclosure. Portions of the metal resonance paths of the meandered metal resonant paths 4111, 4121, 4131 and 4141 of the hybrid multi-band antenna array 4 are curved paths. Therefore, the meandered metal resonant paths 4111, 4121, 4131 and 4141 of the hybrid multi-band antenna array 4 and the meandered metal resonant paths 2111, 2121, 2131 and 2141 of the hybrid multi-band antenna array 2 have different shapes. The first slots 4211, 4221, 4231 and 4241 and the second slots 4212, 4222, 4232 and 4242 of the hybrid multi-band antenna array 4 are also not exactly the same as the first slots 2211, 2221, 2231 and 2241 and the second slots 2212, 2222, 2232 and 2242 of the hybrid multi-band antenna array 2. The plurality of signal coupling lines 4213, 4223, 4233 and 4243 of the hybrid multi-band antenna array 4 and the plurality of signal coupling lines 2213, 2223, 2233 and 2243 of the hybrid multi-band antenna array 2 do not have exactly the same shapes. However, in the hybrid multi-band antenna array 4 the first antenna array 41 generates a first resonant mode that covers at least one first communication band, the second antenna array 42 generates a second resonant mode that covers at least one second communication band, the frequency of the second resonant mode is less than the frequency of the first resonant mode. In the hybrid multi-band antenna array 4, the first intervals d4112, d4123 and d4134 are between 0.23 wavelength and 0.85 wavelength of the lowest operating frequency of the first communication band, and the second intervals d4212, d4223 and d4234 are between 0.23 wavelength and 0.85 wavelength of the lowest operating frequency of the second communication band. Therefore, coupling interference of the far-field radiation energy of the first antenna array 41 and the second antenna array 42 could be reduced effectively. In addition, in the hybrid multi-band antenna array 4 according to this disclosure, the central point positions of the openings of the first slots 4211, 4221, 4231 and 4241 of the plurality of parallel-connected slot antennas 421, 422, 423 and 424 are spaced apart from the central point positions of the openings of the second slots 4212, 4222, 4232 and 4242 at third intervals d431, d432, d433 and d434, respectively. In the hybrid multi-band antenna array 4, the third intervals d431, d432, d433 and d434 are between 0.1 wavelength and 0.7 wavelength of the lowest operating frequency of the second communication band, and path lengths of the plurality of meandered metal resonant paths 4111, 4121, 4131 and 4141 from the loop feeding points 4113, 4123, 4133 and 4143 to the loop shorting points 4112, 4122, 4132 and 4142 are between 0.5 wavelength and 2.0 wavelength of the lowest operating frequency of the first communication band. Therefore, the coupling interference of the near-field radiation energy of the first antenna array 41 and the second antenna array 42 could be reduced effectively. The hybrid multi-band antenna array 4 could achieve the same characteristics as the hybrid multi-band antenna array 2 does. This makes destructive interference on the multibeam radiation patterns of the first antenna array 41 and the second antenna array 42 to be reduced, and the requirements of compact size, high integration and multi-band operation to be achieved successfully. The hybrid multi-band antenna array 4 according to this disclosure could be singly or in plural realized in a communication device. The communication device could be a mobile communication device, a wireless communication device, a mobile operating device, a computer system, telecom equipment, base station equipment, network equipment, or peripheral equipment, such as a computer and a network.

Figure 5:
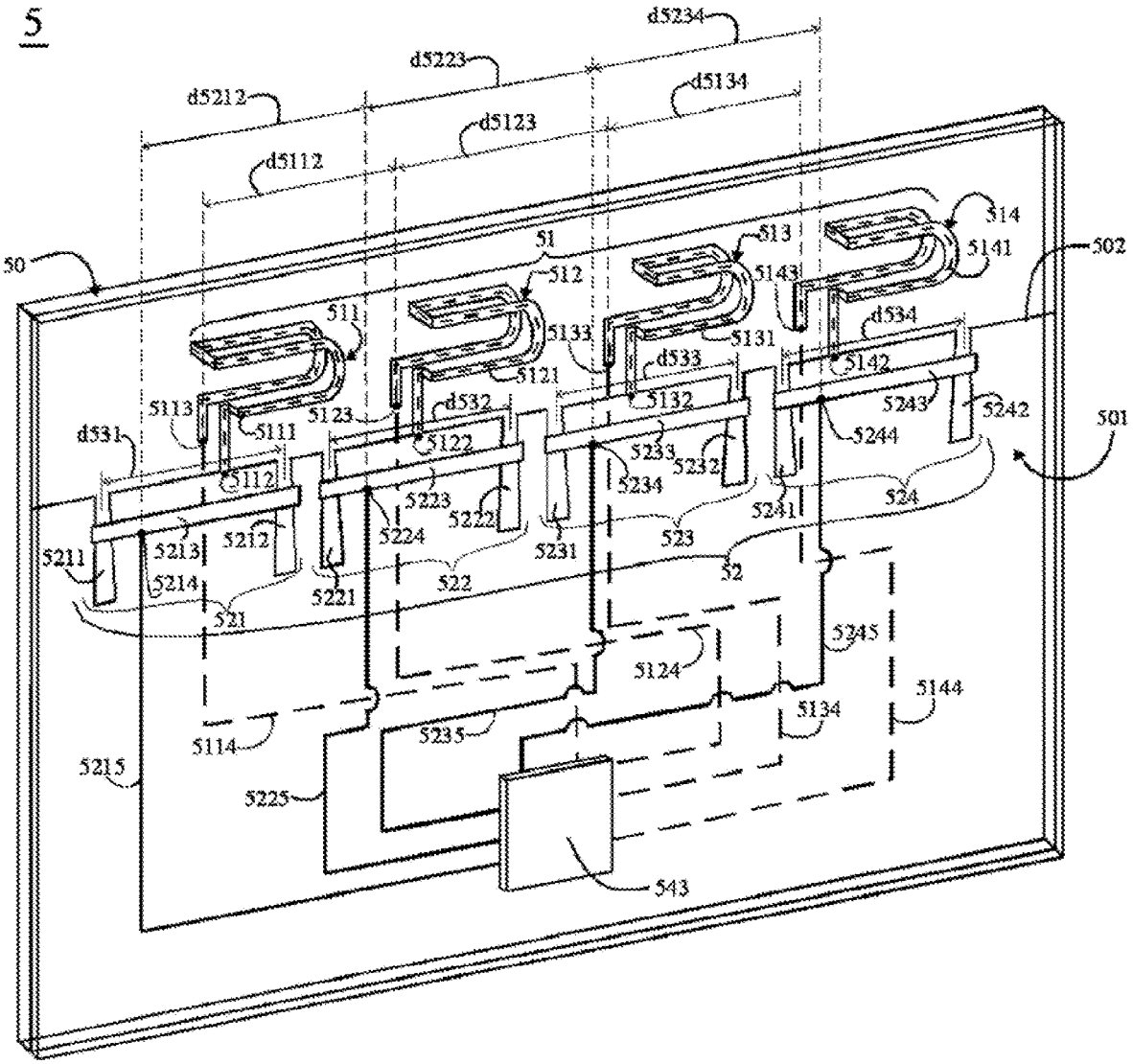
FIG. 5 is a structural diagram of a hybrid multi-band antenna array 5 of an embodiment according to this disclosure.

FIG. 5 is a structural diagram of a hybrid multi-band antenna array 5 of an embodiment according to this disclosure. The hybrid multi-band antenna array 5 comprises a multilayer substrate board 50, a first antenna array 51 and a second antenna array 52. The multilayer substrate board 50 includes a ground conductor structure 501 having a first edge 502. The ground conductor structure 501 is a ground conductor plane. The first antenna array 51 includes a plurality of folded loop antennas 511, 512, 513 and 514. The plurality of folded loop antennas 511, 512, 513 and 514 are integrated with the multilayer substrate board 50, and arranged along the first edge 502 sequentially. The folded loop antennas 511, 512, 513 and 514 have their respective meandered metal resonant paths 5111, 5121, 5131 and 5141. The meandered metal resonant paths 5111, 5121, 5131 and 5141 have their respective loop shorting points 5112, 5122, 5132 and 5142 and loop feeding points 5113, 5123, 5133 and 5143. Each of the loop shorting points 5112, 5122, 5132 and 5142 are electrically connected to the ground conductor structure 501. The loop feeding points 5113, 5123, 5133 and 5143 are spaced apart at first intervals d5112, d5123 and d5134, respectively. The first antenna array 51 is excited to generate a first resonant mode that covers at least one first communication band. The second antenna array 52 includes a plurality of parallel-connected slot antennas 521, 522, 523 and 524. The plurality of parallel-connected slot antennas 521, 522, 523 and 524 are integrated with the multilayer substrate board 50, and arranged along the first edge 502 sequentially. The parallel-connected slot antennas 521, 522, 523 and 524 have their respective first slots 5211, 5221, 5231 and 5241, second slots 5212, 5222, 5232 and 5242, and signal coupling lines 5213, 5223, 5233 and 5243 extending across the first slots 5211, 5221, 5231 and 5241 and the second slots 5212, 5222, 5232 and 5242, respectively. The plurality of first slots 5211, 5221, 5231 and 5241 and the plurality of second slots 5212, 5222, 5232 and 5242 are disposed on the ground conductor structure 501. The plurality of signal coupling lines 5213, 5223, 5233 and 5243 have their respective slot feeding points 5214, 5224, 5234 and 5244. The slot feeding points 5214, 5224, 5234 and 5244 are spaced apart at second intervals d5212, d5223 and d5234, respectively. The second antenna array 52 is excited to generate a second resonant mode that covers at least one second communication band. The frequency of the second resonant mode is less than the frequency of the first resonant mode. The ground conductor structure 501 is a ground conductor plane. The first intervals d5112, d5123 and d5134 are between 0.23 wavelength and 0.85 wavelength of the lowest operating frequency of the first communication band. The second intervals d5212, d5223 and d5234 are between 0.23 wavelength and 0.85 wavelength of the lowest operating frequency of the second communication band. The central point positions of the openings of the first slots 5211, 5221, 5231 and 5241 of the plurality of parallel-connected slot antennas 521, 522, 523 and 524 are spaced apart from the central point positions of the openings of the second slots 5212, 5222, 5232 and 5242 at third intervals d531, d532, d533 and d534, respectively. The third intervals d531, d532, d533 and d534 are between 0.1 wavelength and 0.7 wavelength of the lowest operating frequency of the second communication band. Path lengths of the plurality of meandered metal resonant paths 5111, 5121, 5131 and 5141 from the loop feeding points 5113, 5123, 5133 and 5143 to the loop shorting points 5112, 5122, 5132 and 5142 are between 0.5 wavelength and 2.0 wavelength of the lowest operating frequency of the first communication band. Path widths of the plurality of meandered metal resonant paths 5111, 5121, 5131 and 5141 are less than or equal to 0.25 wavelength of the lowest operating frequency of the first communication band. Slot lengths from opening ends to closing ends of the plurality of first slots 5211, 5221, 5231 and 5241 and the plurality of second slots 5212, 5222, 5232 and 5242 are less than or equal to 0.6 wavelength of the lowest operating frequency the second communication band 5252. Slot widths of the plurality of first slots 5211, 5221, 5231 and 5241 and the plurality of second slots 5212, 5222, 5232 and 5242 are less than or equal to 0.2 wavelength of the lowest operating frequency of the second communication band.

As shown in FIG. 5, in the hybrid multi-band antenna array 5 according to this disclosure the loop feeding points 5113, 5123, 5133 and 5143 and the slot feeding points 5214, 5224, 5234 and 5244 are electrically coupled through first antenna array transmission lines 5114, 5124, 5134 and 5144 and second antenna array transmission lines 5215, 5225, 5235 and 5245, respectively, to a third beamforming circuit 543. The first antenna array transmission lines 5114, 5124, 5134 and 5144 and the second antenna array transmission lines 5215, 5225, 5235 and 5245 could be a microstrip transmission line architecture, a strip line architecture, a co-axial transmission line architecture, a co-planar waveguide transmission line architecture, a grounded co-planar waveguide transmission line architecture, a combination thereof, or an improved architecture. The third beamforming circuit 543 could operate in multiple frequency bands to excite the first antenna array 51 to generate the first resonant mode. The third beamforming circuit 543 could generate signals with different phases, allowing the first antenna array 51 to generate different radiation patterns. The third beamforming circuit 543 could also excite the second antenna array 52 to generate the second resonant mode. The third beamforming circuit 543 generates signals with different phases, allowing the second antenna array 52 to generate different radiation patterns. The third beamforming circuit 543 could be a multiple frequencies power combining circuit, a phase controlling circuit, a frequency up-down-conversion circuit, an impedance matching circuit, an amplifier circuit, an integrated circuit chip or a radio frequency module.

FIG. 5 shows the hybrid multi-band antenna array 5 of an embodiment according to this disclosure. Portions of metal resonance paths of the meandered metal resonant paths 5111, 5121, 5131 and 5141 are curved paths, and the meandered metal resonant paths 5111, 5121, 5131 and 5141 and the meandered metal resonant paths 2111, 2121, 2131 and 2141 of the hybrid multi-band antenna array 2 do not have exactly the same shapes. The shapes of the first slots 5211, 5221, 5231 and 5241 and the second slots 5212, 5222, 5232 and 5242 of the hybrid multi-band antenna array 5 and the shapes of the first slots 2211, 2221, 2231 and 2241 and the second slots 2212, 2222, 2232 and 2242 of the hybrid multi-band antenna array 2 are also different slightly. The third beamforming circuit 543, which operates in multiple frequency bands, is used to replace the first beamforming circuit 241 and the second beamforming circuit 242 of the hybrid multi-band antenna array 2. However, in the hybrid multi-band antenna array 5 according to this disclosure the first antenna array 51 is excited to generate a first resonant mode that covers at least one first communication band, the second antenna array 52 is excited to generate a second resonant mode that covers at least one second communication band, the frequency of the second resonant mode is less than the frequency of the first resonant mode. In the hybrid multi-band antenna array 5, the first intervals d5112, d5123 and d5134 are between 0.23 wavelength and 0.85 wavelength of the lowest operating frequency of the first communication band, and the second intervals d5212, d5223 and d5234 are between 0.23 wavelength and 0.85 wavelength of the lowest operating frequency of the second communication band. Therefore, the coupling interference of far-field radiation energy of the first antenna array 51 and the second antenna array 52 could be reduced effectively. In the hybrid multi-band antenna array 5 according to this disclosure, the central point positions of the opening of the first slots 5211, 5221, 5231 and 5241 of the plurality of parallel-connected slot antennas 521, 522, 523 and 524 are spaced apart from the central positions of the openings of the second slots 5212, 5222, 5232 and 5242 at third intervals d531, d532, d533 and d534, respectively. The third intervals d531, d532, d533 and d534 are between 0.1 wavelength and 0.7 wavelength of the lowest operating frequency of the second communication band, and path lengths of the plurality of meandered metal resonant paths 5111, 5121, 5131 and 5141 from the loop feeding points 5113, 5123, 5133 and 5143 to the loop shorting points 5112, 5122, 5132 and 5142 are between 0.5 wavelength and 2.0 wavelength of the lowest operating frequency of the first communication band. Therefore, the coupling interference of near-field radiation energy of the first antenna array 51 and the second antenna array 52 could be reduced effectively, and the hybrid multi-band antenna array 5 could achieve the same characteristics as the hybrid multi-band antenna array 2 does. This makes the destructive interference on the multibeam radiation pattern of the first antenna array 51 and the second antenna array 52 to be reduced successfully, and the requirements of compact size, high integration and multi-band operation could be achieved successfully. The hybrid multi-band antenna array 5 according to this disclosure could be singly or in plural realized in a communication device. The communication device could be a mobile communication device, a wireless communication device, a mobile operating device, a computer system, telecom equipment, base station equipment, network equipment, or peripheral equipment, such as a computer and a network.

Figure 6A:
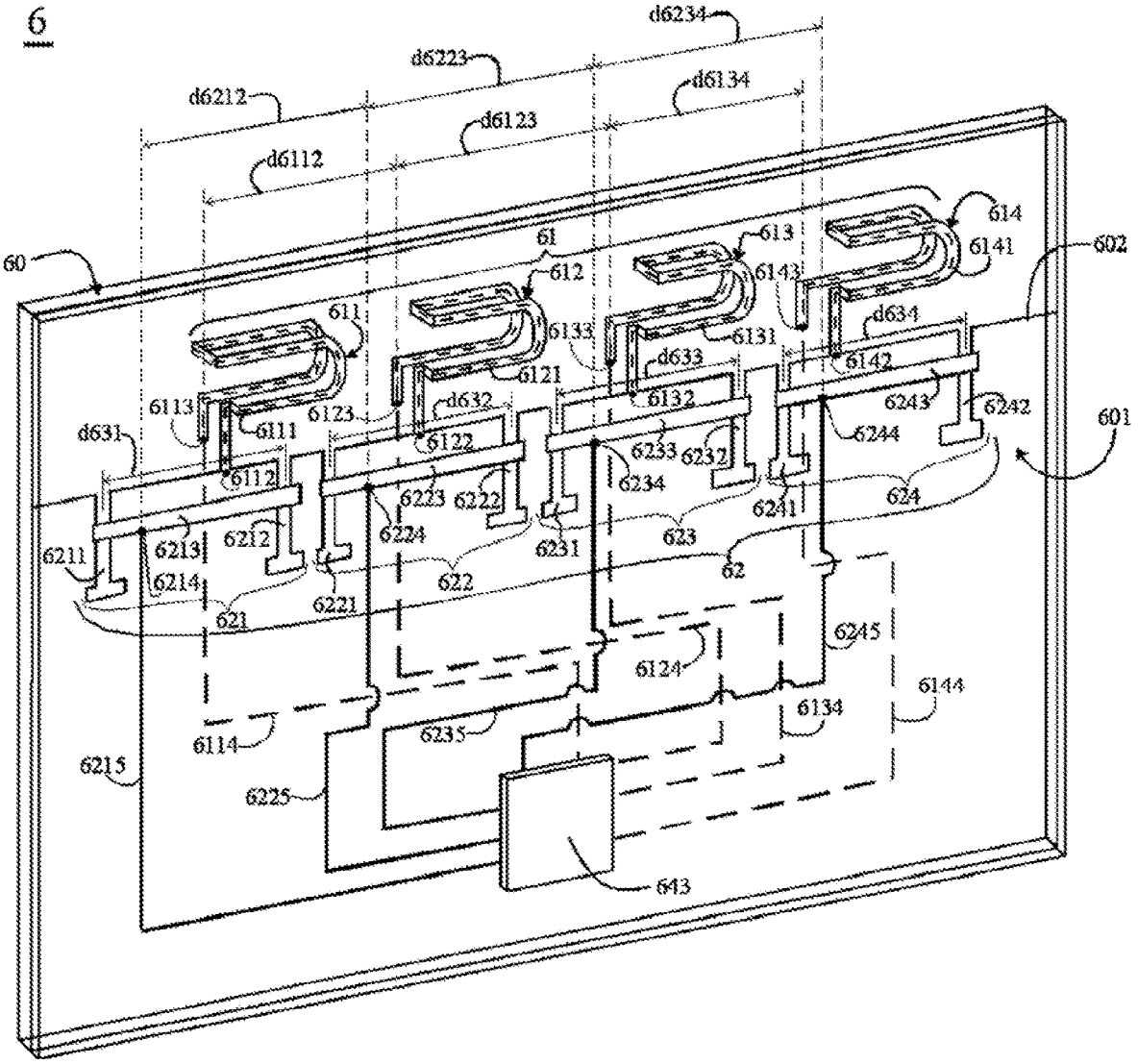
FIG. 6A is a structural diagram of a hybrid multi-band antenna array 6 of an embodiment according to this disclosure.
Figure 6B:
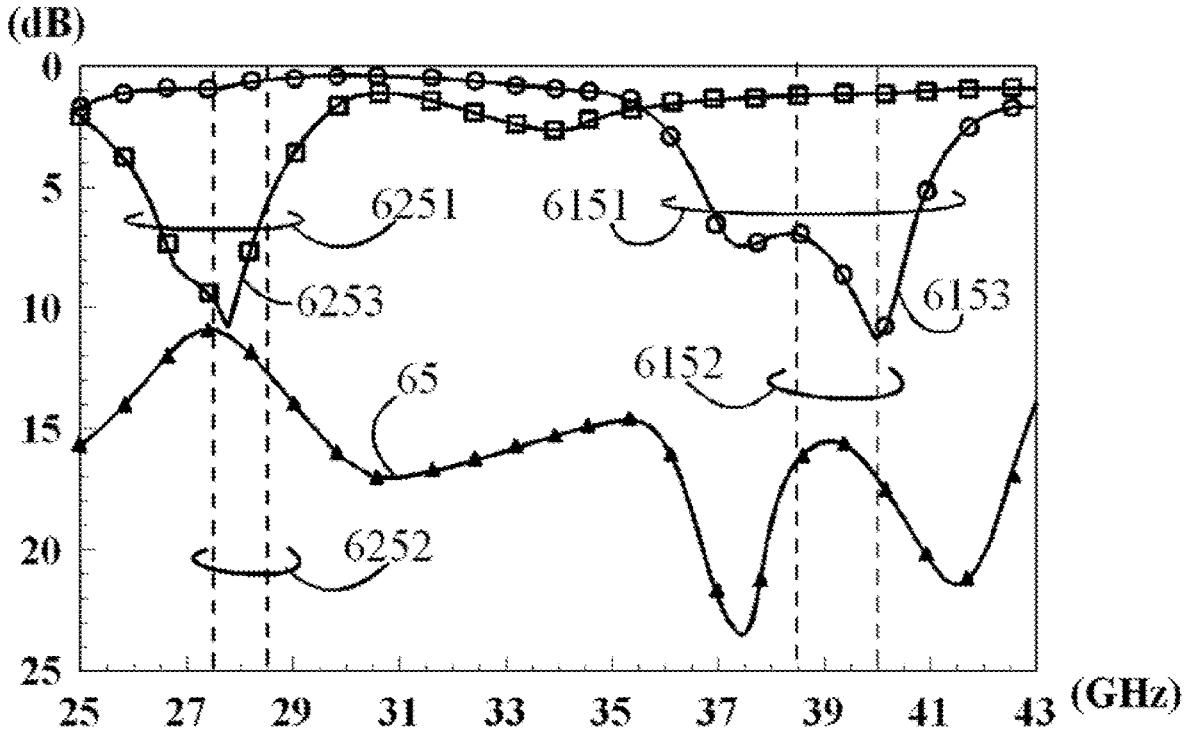
FIG. 6B is return loss and isolation curve diagrams of a hybrid multi-band antenna array 6 of an embodiment according to this disclosure.

FIG. 6A is a structural diagram of a hybrid multi-band antenna array 6 of an embodiment according to this disclosure. FIG. 6B is return loss and isolation curve diagrams of the hybrid multi-band antenna array 6 of an embodiment according to this disclosure. The hybrid multi-band antenna array 6 comprises a multilayer substrate board 60, a first antenna array 61 and a second antenna array 62. The multilayer substrate board 60 includes a ground conductor structure 601 having a first edge 602. The ground conductor structure 601 is a ground conductor plane. The first antenna array 61 includes a plurality of folded loop antennas 611, 612, 613 and 614. The plurality of folded loop antennas 611, 612, 613 and 614 are integrated with the multilayer substrate board 60, and arranged along the first edge 602 sequentially. The folded loop antennas 611, 612, 613 and 614 include their respective meandered metal resonant paths 6111, 6121, 6131 and 6141. The meandered metal resonant paths 6111, 6121, 6131 and 6141 have their respective loop shorting points 6112, 6122, 6132 and 6142 and loop feeding points 6113, 6123, 6133 and 6143. Each of the loop shorting points 6112, 6122, 6132 and 6142 are electrically connected to the ground conductor structure 601. The loop feeding points 6113, 6123, 6133 and 6143 are spaced apart at first intervals d6112, d6123 and d6134, respectively. The first antenna array 61 is excited to generate a first resonant mode 6151 that covers at least one first communication band 6152 (as shown in FIG. 6B). The second antenna array 62 includes a plurality of parallel-connected slot antennas 621, 622, 623 and 624. The plurality of parallel-connected slot antennas 621, 622, 623 and 624 are integrated with the multilayer substrate board 60, and arranged along the first edge 602 sequentially. The parallel-connected slot antennas 621, 622, 623 and 624 have their respective first slots 6211, 6221, 6231 and 6241, second slots 6212, 6262, 6232 and 6242, and signal coupling lines 6213, 6223, 6233 and 6243 extending across the first slots 6211, 6221, 6231 and 6241 and the second slots 6212, 6262, 6232 and 6242, respectively. The plurality of first slots 6211, 6221, 6231 and 6241 and the plurality of second slots 6212, 6262, 6232 and 6242 are disposed on the ground conductor structure 601. The plurality of signal coupling lines 6213, 6223, 6233 and 6243 have their respective slot feeding points 6214, 6224, 6234 and 6244. The slot feeding points 6214, 6224, 6234 and 6244 are spaced apart at second intervals d6212, d6223 and d6234 respectively. The second antenna array 62 is excited to generate a second resonant mode 6251 that covers at least one second communication band 6252. The frequency of the second resonant mode 6251 is lower than the frequency of the first resonant mode 6151 (as shown in FIG. 6B). The ground conductor structure 601 is a ground conductor plane. The first intervals d6112, d6123 and d6134 are between 0.23 wavelength and 0.85 wavelength of the lowest operating frequency the first communication band 6152. The second intervals d6212, d6223 and d6234 are between 0.23 wavelength and 0.85 wavelength of the lowest operating frequency the second communication band 6252. The central point positions of the openings of the first slots 6211, 6221, 6231 and 6241 of the plurality of parallel-connected slot antennas 621, 622, 623 and 624 are spaced apart from the central point positions of the openings of the second slots

6212, 6262, 6232 and 6242 at third intervals d631, d632, d633 and d634, respectively. The third intervals d631, d632, d633 and d634 are between 0.1 wavelength and 0.7 wavelength of the lowest operating frequency of the second communication band 6252. Path lengths of the plurality of meandered metal resonant paths 6111, 6161, 6131 and 6141 from the loop feeding points 6113, 6123, 6133 and 6143 to the loop shorting points 6112, 6122, 6132 and 6142 are between 0.5 wavelength and 2.0 wavelength of the lowest operating frequency of the first communication band 6152. Path widths of the plurality of meandered metal resonant paths 6111, 6121, 6131 and 6141 are less than or equal to 0.25 wavelength of the lowest operating frequency of the first communication band 6152. Slot lengths from opening ends to closing ends of the plurality of first slots 6211, 6221, 6231 and 6241 and the plurality of second slots 6212, 6222, 6232 and 6242 are less than or equal to 0.6 wavelength of the lowest operating frequency of the second communication band 6252. Slot widths of the plurality of first slots 6211, 6221, 6231 and 6241 and the plurality of second slots 6212, 6222, 6232 and 6242 are less than or equal to 0.2 wavelength of the lowest operating frequency of the second communication band 6252. As shown in FIG. 6A, in the hybrid multi-band antenna array 6 according to this disclosure the loop feeding points 6113, 6123, 6133 and 6143 and the slot feeding points 6214, 6224, 6234 and 6244 are electrically coupled through first antenna array transmission lines 6114, 6124, 6134 and 6144 and second antenna array transmission lines 6215, 6225, 6235 and 6245, respectively, to a third beamforming circuit 643. The first antenna array transmission lines 6114, 6124, 6134 and 6144 and the second antenna array transmission lines 6215, 6225, 6235 and 6245 could be a microstrip transmission line architecture, a strip line architecture, a co-axial transmission line architecture, a co-planar waveguide transmission line architecture, a grounded co-planar waveguide transmission line architecture, a combination thereof, or an improved architecture. The third beamforming circuit 643 could operate in multiple frequency bands to excite the first antenna array 61 to generate the first resonant mode. The third beamforming circuit 643 could generate signals with different phases, allowing the first antenna array 61 to generate different radiation patterns. The third beamforming circuit 643 excites the second antenna array 62 to generate the second resonant mode. The third beamforming circuit 643 could generate signals with different phases, allowing the second antenna array 62 to generate different radiation patterns. The third beamforming circuit 643 could be a multiple frequencies power combining circuit, a phase controlling circuit, a frequency up-down-conversion circuit, an impedance matching circuit, an amplifier circuit, an integrated circuit chip or a radio frequency module.

FIG. 6A discloses the hybrid multi-band antenna array 6 of an embodiment. Portions of metal resonance paths of the meandered metal resonant paths 6111, 6121, 6131 and 6141 are curve paths, and shapes of the meandered metal resonant paths 6111, 6121, 6131 and 6141 of the hybrid multi-band antenna array 6 and shapes of the meandered metal resonant paths 2111, 2121, 2131 and 2141 of the hybrid multi-band antenna array 2 are not exactly the same. Shapes of the first slots 6211, 6221, 6231 and 6241 and the second slots 6212, 6222, 6232 and 6242 of the hybrid multi-band antenna array 6 are also slightly different from shapes of the first slots 2211, 2221, 2231 and 2241 and the second slots 2212, 2222, 2232 and 2242 of the hybrid multi-band antenna array 2. The third beamforming circuit 643, which operates in multiple frequency bands, is used to replace the first beamforming circuit 241 and the second beamforming circuit 242 of the hybrid multi-band antenna array 2. However, in the hybrid multi-band antenna array 6 according to this disclosure the first antenna array 61 is excited to generate a first resonant mode 6151 that covers at least one first communication band 6152 (as shown in FIG. 6B), the second antenna array 62 is excited to generate a second resonant mode 6251 that covers at least one second communication band 6252, the frequency of the second resonant mode 6251 is lower than the frequency of the first resonant mode 6151 (as shown in FIG. 6B). The first intervals d6112, d6123 and d6134 are between 0.23 wavelength and 0.85 wavelength of the lowest operating frequency of the first communication band 6152, and the second intervals d6212, d6223 and d6234 are between 0.23 wavelength and 0.85 wavelength of the lowest operating frequency of the second communication band 6252. Therefore, the coupling interference of far-field radiation energy of the first antenna array 61 and the second antenna array 62 could be reduced effectively. In addition, in the hybrid multi-band antenna array 6 according to this disclosure, the central point positions of the openings of the first slots 6211, 6221, 6231 and 6241 of the plurality of parallel-connected slot antennas 621, 622, 623 and 624 are spaced apart from the central point positions of the openings of the second slots 6212, 6222, 6232 and 6242 at third intervals d631, d632, d633 and d234, respectively. In the hybrid multi-band antenna array 6, the third intervals d631, d632, d633 and d634 are between 0.1 wavelength and 0.7 wavelength of the lowest operating frequency of the second communication band 6252, and path lengths of the plurality of meandered metal resonant paths 6111, 6161, 6131 and 6141 from the loop feeding points 6113, 6123, 6133 and 6143 to the loop shorting points 6112, 6122, 6132 and 6142 are between 0.5 wavelength and 2.0 wavelength of the lowest operating frequency of the first communication band 6152. Therefore, the coupling interference on near-field radiation energy of the first antenna array 61 and the second antenna array 62 could be reduced effectively. The hybrid multi-band antenna array 6 could achieve the same characteristics as the hybrid multi-band antenna array 2 does. This makes destructive interference on the multibeam radiation pattern of the first antenna array 61 and the second antenna array 62 could be reduced, and the requirements of minimization, high integration and multi frequency band operation to be achieved successfully.

FIG. 6B is return loss and isolation curve diagrams of the hybrid multi-band antenna array 6 of an embodiment according to this disclosure. The first antenna array 61 has a return loss curve 6153. The second antenna array 62 has a return loss curve 6253. The first antenna array 61 and the second antenna array 62 have isolation curves 65. In experiments, the first edge 602 of the ground conductor plane 601 is about 35 mm long, a path length of the meandered metal resonant path 6111 from the loop feeding point 6113 to the loop shorting point 6112 is about 13 mm, a path length of the meandered metal resonant path 6121 from the loop feeding point 6123 to the loop shorting point 6122 is about 12.8 mm, a path length of the meandered metal resonant path 6131 from the loop feeding point 6133 to the loop shorting point 6132 is about 13.2 mm, a path length of the meandered metal resonant path 6141 from the loop feeding point 6143 to the loop shorting point 6142 is about 13.1 mm, the first interval d6112 is about 4.2 mm, the first interval d6123 is about 4.1 mm, the first interval d6134 is about 3.9 mm, the second interval d6212 is about 4.9 mm, the second interval d6223 is about 5.1 mm, the second interval d6234 is about 5.2 mm, the third interval d631 is about 4.1 mm, the third interval d632 is about 4.2 mm, the third interval d633 is about 4 mm, and the third interval d634 is about 4.25 mm. As shown in FIG. 6B, the first antenna array 61 is excited to generate a first resonant mode 6151 that covers at least one first communication band 6152. As shown in FIG. 6B, the second antenna array 62 is excited to generate a second resonant mode 6251 that covers at least one second communication band 6252. The frequency of the second resonant mode 6251 is lower than the frequency of the first resonant mode 6151. In an embodiment, the first resonant mode 6151 covers at least one first communication band 6152 (38.5 GHz-40 GHz), the second resonant mode 6251 covers at least one second communication band 6252 (27.5 GHz-28.5 GHz), and the frequency of the second resonant mode 6251 is lower than the frequency of the first resonant mode 6151. The lowest operating frequency of the first communication band 6152 is about 38.5 GHz. The lowest operating frequency of the second communication band 6252 is about 27.5 GHz. As shown in FIG. 6B, the isolation curves 65 of the first antenna array 61 and the second antenna array 62 are greater than 15 dB in the first communication band 6152, and are greater than 10 dB in the second communication band 6252, which prove well enough for isolation performance.

Figure 6C:
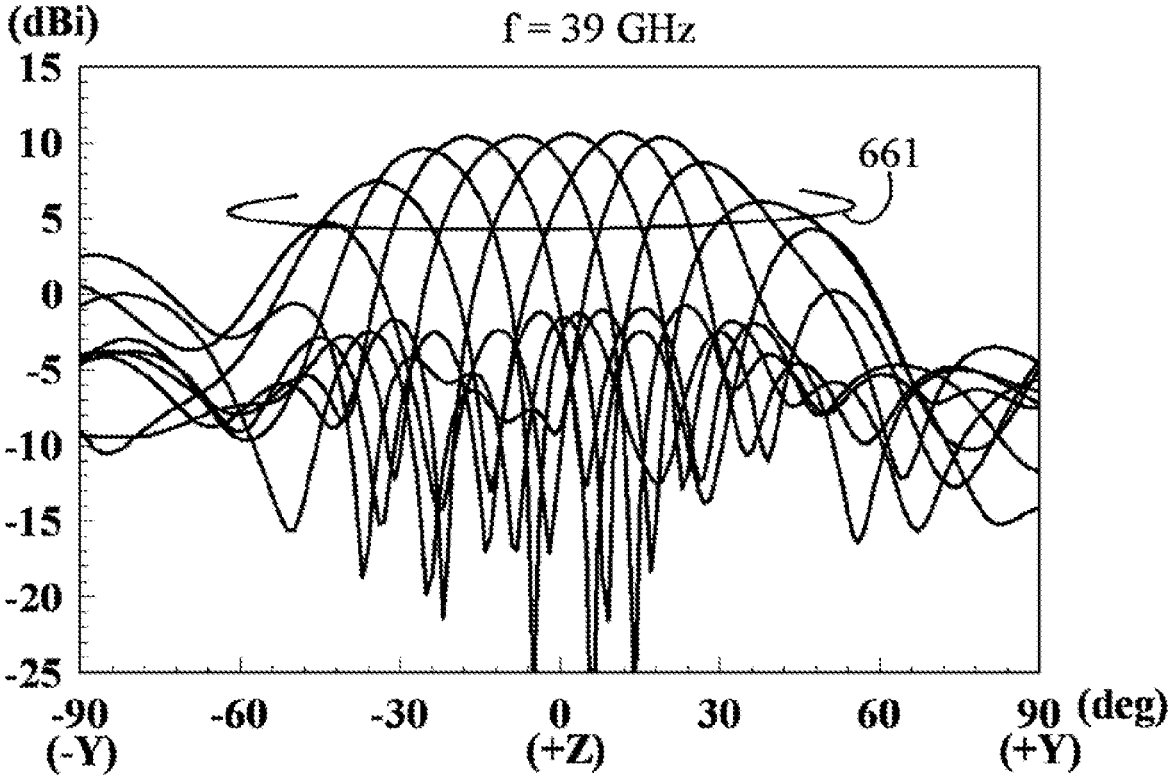
FIG. 6C is a multibeam scanning 2D radiation pattern diagram of a first antenna array 61 of a hybrid multi-band antenna array 6 in a first communication band of an embodiment according to this disclosure.
Figure 6C:
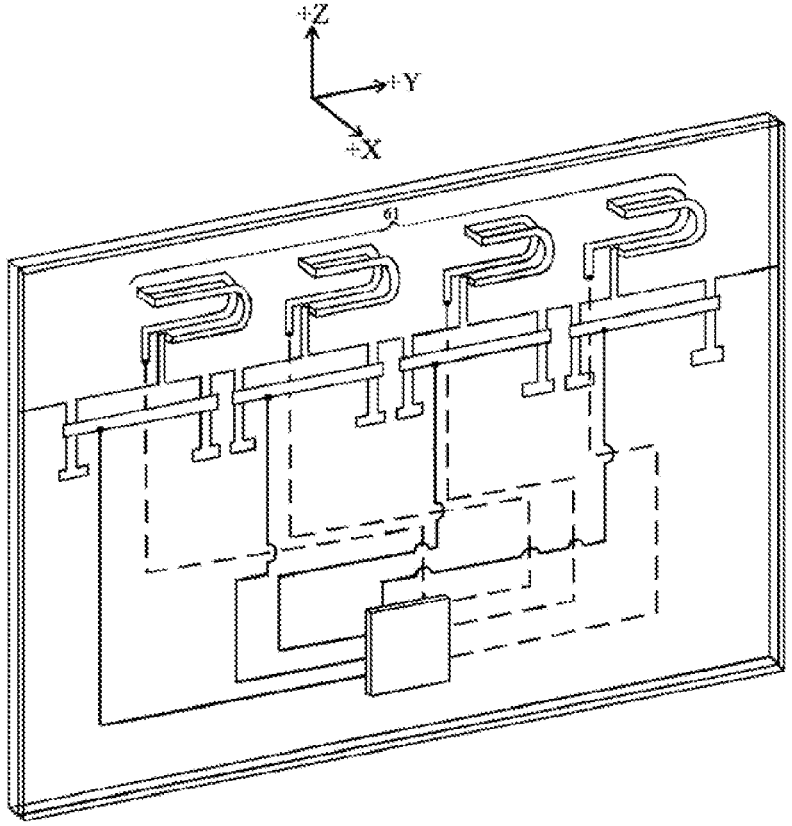
Figure 6D:
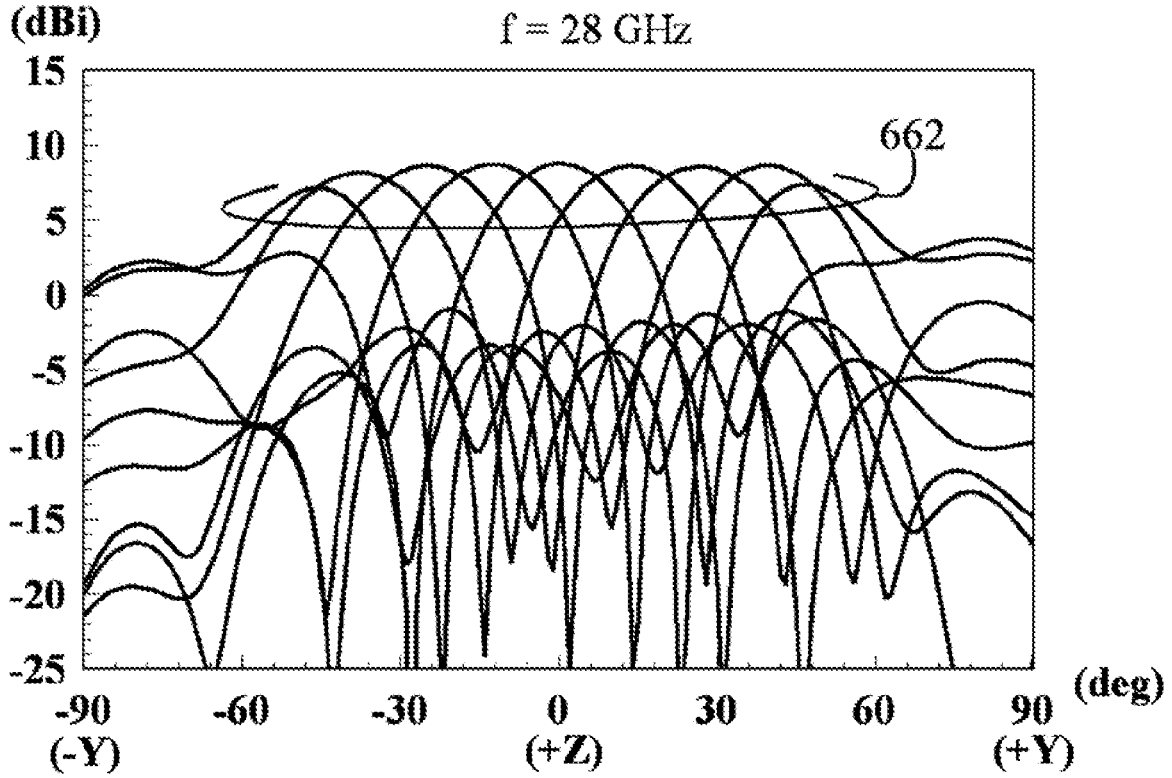
FIG. 6D is a multibeam scanning 2D radiation pattern diagram of a second antenna array 62 of a hybrid multi-band antenna array 6 in a second communication band of an embodiment according to this disclosure.
Figure 6D:
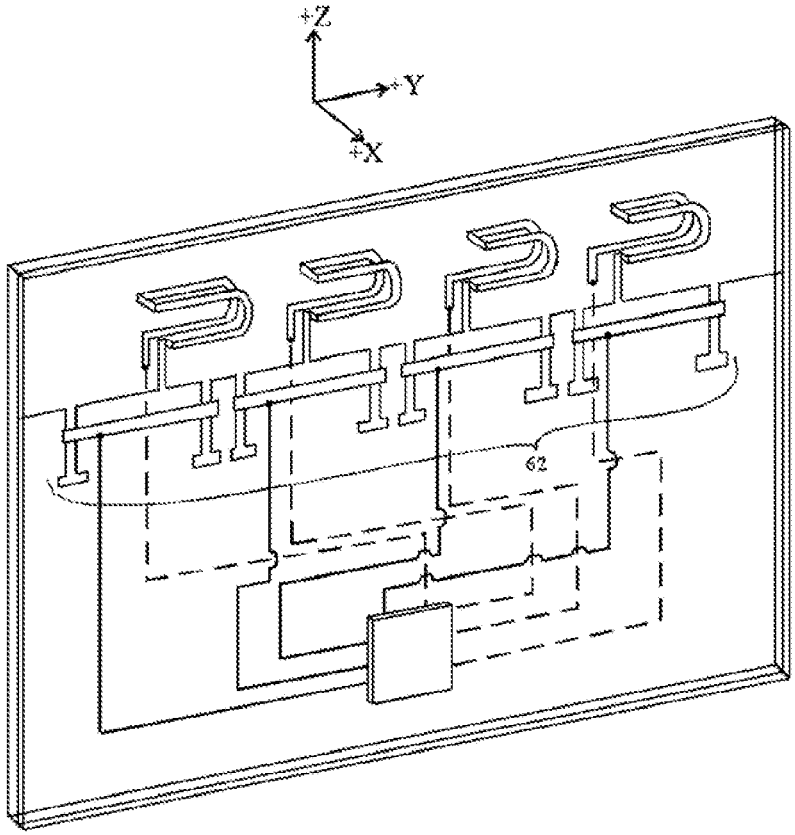

FIG. 6C is a multibeam scanning 2D radiation pattern diagram of a first antenna array 61 of the hybrid multi-band antenna array in a first communication band of an embodiment according to this disclosure. FIG. 6D is a multibeam scanning 2D radiation pattern diagram of a second antenna array 62 of the hybrid multi-band antenna array in a second communication band of an embodiment according to this disclosure. It can be clearly seen from the variation curve 661 of multibeam 2D radiation patterns of the first antenna array 61 of FIG. 6C and the variation curve 662 of multibeam 2D radiation pattern of the second antenna array 62 of FIG. 6D that far-field main radiation beams of the first antenna array 61 and the second antenna array 62 could coexist and cooperate in different frequency bands, and will not be destructed and offset by each other, which prove that wireless communication transmission of multi frequency bands could be achieved.

The operations of communication bands, the experimental data, the number of layers of the medium substrate board, and the number of layers of the ground conductor plane encompasses in FIGS. 6B-6D are proposed to prove the technical effect and characteristic of the hybrid multi-band antenna array 6 of an embodiment according to this disclosure of FIG. 6A, and are not used to limit the communication band operations, applications and specifications encompassed in practical applications of the hybrid multi-band antenna array 6 according to this disclosure. The hybrid multi-band antenna array 6 according to this disclosure could be singly or in plural realized in a communication device. The communication device could be a mobile communication device, a wireless communication device, a mobile operating device, a computer system, telecom equipment, base station equipment, network equipment, or peripheral equipment, such as a computer and a network.

Figure 7:
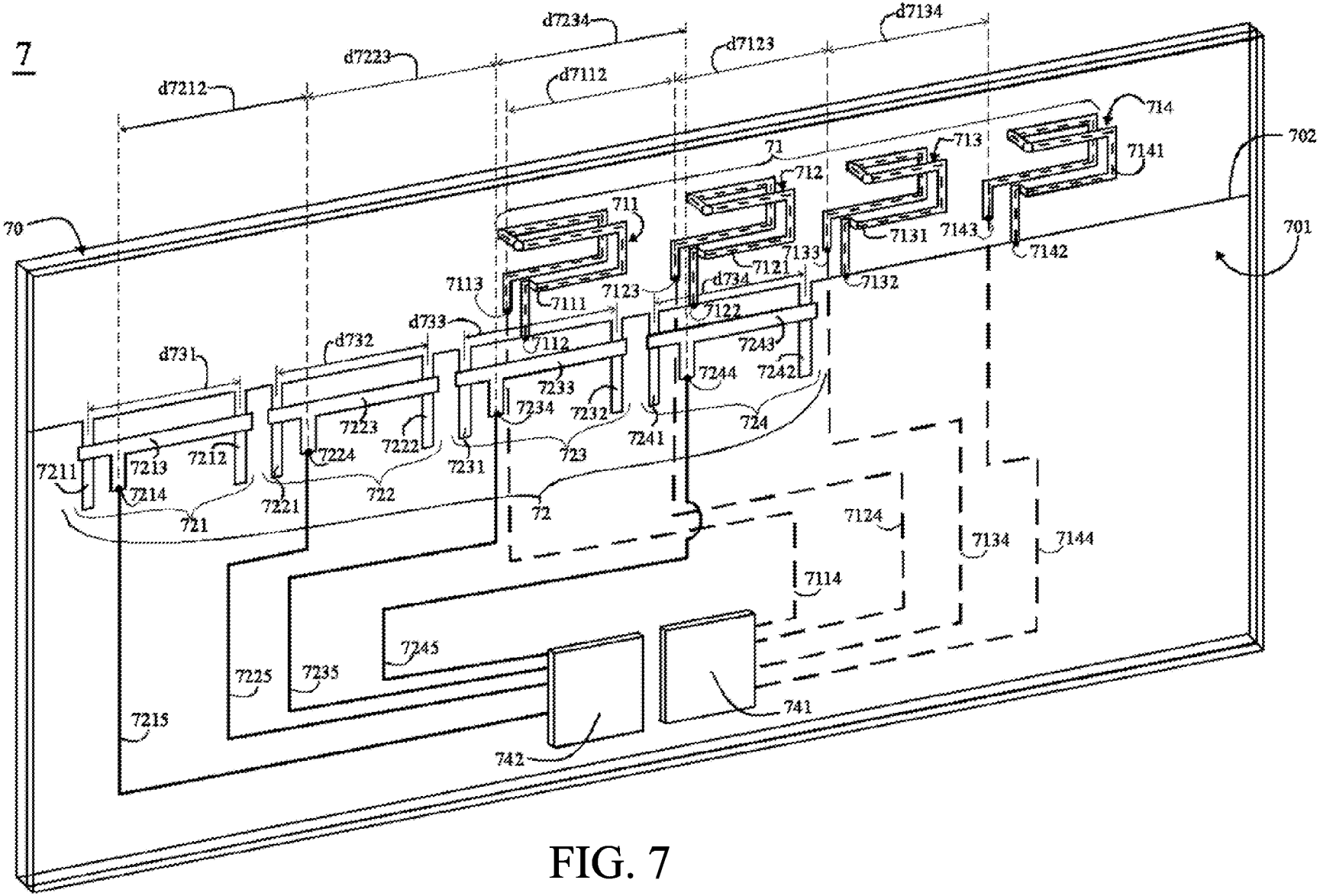
FIG. 7 is a structural diagram of a hybrid multi-band antenna array 7 of an embodiment according to this disclosure.

FIG. 7 is a structural diagram of a hybrid multi-band antenna array 7 of an embodiment according to this disclosure. The hybrid multi-band antenna array 7 comprises a multilayer substrate board 70, a first antenna array 71 and a second antenna array 72. The multilayer substrate board 70 includes a ground conductor structure 701 having a first edge 702. The first antenna array 71 includes a plurality of folded loop antennas 711, 712, 713 and 714. The plurality of folded loop antennas 711, 712, 713 and 714 are integrated with the multilayer substrate board 70, and arranged along the first edge 702 sequentially. The folded loop antennas 711, 712, 713 and 714 have their respective meandered metal resonant paths 7111, 7121, 7131 and 7141. The meandered metal resonant paths 7111, 7121, 7131 and 7141 have their respective loop shorting points 7112, 7122, 7132 and 7142 and loop feeding points 7113, 7123, 7133 and 7143. The loop shorting points 7112, 7122, 7132 and 7142 are electrically connected to the ground conductor structure 701. The loop feeding points 7113, 7123, 7133 and 7143 are spaced apart at first intervals d7112, d7123 and d7134, respectively. The first antenna array 71 is excited to generate a first resonant mode that covers at least one first communication band. The second antenna array 72 comprises a plurality of parallel-connected slot antennas 721, 722, 723 and 724. The plurality of parallel-connected slot antennas 721, 722, 723 and 724 are integrated with the multilayer substrate board 70, and arranged along the first edge 702 sequentially. The parallel-connected slot antennas 721, 722, 723 and 724 comprise their respective first slots 7211, 7221, 7231 and 7241, second slots 7212, 7222, 7232 and 7242, and signal coupling lines 7213, 7223, 7233 and 7243 extending across the first slots 7211, 7221, 7231 and 7241 and the second slots 7212, 7222, 7232 and 7242, respectively. The plurality of first slots 7211, 7221, 7231 and 7241 and the plurality of second slots 7212, 7222, 7232 and 7242 are disposed on the ground conductor structure 701. The plurality of signal coupling lines 7213, 7223, 7233 and 7243 comprise their respective slot feeding points 7214, 7224, 7234 and 7244. The slot feeding points 7214, 7224, 7234 and 7244 are spaced apart at second intervals d7212, d7223 and d7234, respectively. The second antenna array 72 is excited to generate a second resonant mode that covers at least one second communication band. The frequency of the second resonant mode is lower than the frequency of the first resonant mode. The ground conductor structure 701 is a ground conductor plane. The first intervals d7112, d7123 and d7134 are between 0.23 wavelength and 0.85 wavelength of the lowest operating frequency of the first communication band. The second intervals d7212, d7223 and d7234 are between 0.23 wavelength and 0.85 wavelength of the lowest operating frequency of the second communication band. The central point positions of the openings of the first slots 7211, 7221, 7231 and 7241 of the plurality of parallel-connected slot antennas 721, 722, 723 and 724 are spaced apart from the central point positions of the openings of the second slots 7212, 7222, 7232 and 7242 at third intervals d731, d732, d733 and d734, respectively. The third intervals d731, d732, d733 and d734 are between 0.1 wavelength and 0.7 wavelength of the lowest operating frequency of the second communication band. Path lengths of the plurality of meandered metal resonant paths 7111, 7121, 7131 and 7141 from the loop feeding points 7113, 7123, 7133 and 7143 to the loop shorting points 7112, 7122, 7132 and 7142 are between 0.5 wavelength and 2.0 wavelength of the lowest operating frequency of the first communication band. Path widths of the plurality of meandered metal resonant paths 7111, 7121, 7131 and 7141 are less than or equal to 0.25 wavelength of the lowest operating frequency of the first communication band. Slot lengths of opening ends to closing ends of the plurality of first slots 7211, 7221, 7231 and 7241 and the plurality of second slots 7212, 7222, 7232 and 7242 are less than or equal to 0.6 wavelength of the lowest operating frequency of the second communication band. Slot widths of the plurality of first slots 7211, 7221, 7231 and 7241 and the plurality of second slots 7212, 7222, 7232 and 7242 are less than or equal to 0.2 wavelength of the lowest operating frequency of the second communication band. The loop feeding points 7113, 7123, 7133 and 7143 are electrically coupled through first antenna array transmission lines 7114, 7124, 7134 and 7144, respectively, to a first beamforming circuit 741. The slot feeding points 7214, 7224, 7234 and 7244 are electrically coupled through second antenna array transmission lines 7215, 7225, 7235 and 7245, respectively, to a second beamforming circuit 742. The first antenna array transmission lines 7114, 7124, 7134 and 7144 and the second antenna array transmission lines 7215, 7225, 7235 and 7245 could be a microstrip transmission line architecture, a strip line architecture, a co-axial transmission line architecture, a co-planar waveguide transmission line architecture, a grounded co-planar waveguide transmission line architecture, a combination thereof, or an improved architecture. The first beamforming circuit 741 excites the first antenna array 71 to generate the first resonant mode. The first beamforming circuit 741 could generate signals with different phases, allowing the first antenna array 71 to generate different radiation patterns. The second beamforming circuit 742 excites the second antenna array 72 to generate the second resonant mode. The second beamforming circuit 742 could generate signals with different phases, allowing the second antenna array 72 to generate different radiation patterns. The first beamforming circuit 741 and the second beamforming circuit 742 could be a power combining circuit, a phase controlling circuit, a frequency up-down-conversion circuit, an impedance matching circuit, an amplifier circuit, an integrated circuit chip or a radio frequency module.

In the hybrid multi-band antenna array 7 according to this disclosure, the plurality of signal coupling lines 7213, 7223, 7233 and 7243 and the plurality of signal coupling lines 2213, 2223, 2233 and 2243 of the hybrid multi-band antenna array 2 do not have exactly the same shapes, and only a portion of the plurality of folded loop antennas 711 and 712 and a portion of the plurality of parallel-connected slot antennas 723 and 724 are overlapped on the first edge 702. However, in the hybrid multi-band antenna array 7 according to this disclosure the first antenna array 71 is still excited to generate a first resonant mode that covers at least one first communication band successfully, the second antenna array 72 is also excited to generate a second resonant mode that covers at least one second communication band successfully, and the frequency of the second resonant mode is lower than the frequency of the first resonant mode. In the hybrid multi-band antenna array 7, the first intervals d7112, d7123 and d7134 are between 0.23 wavelength and 0.85 wavelength of the lowest operating frequency of the first communication band, and the second intervals d7212, d7223 and d7234 are between 0.23 wavelength and 0.85 wavelength of the lowest operating frequency of the second communication band. Therefore, the coupling interference of far-field radiation energy of the first antenna array 71 and the second antenna array 72 could be reduced effectively. In the hybrid multi-band antenna array 7 according to this disclosure, the central point positions of the openings of the first slots 7211, 7221, 7231 and 7241 of the plurality of parallel-connected slot antennas 721, 722, 723 and 724 and the central point positions of the openings of the second slots 7212, 7222, 7232 and 7242 are spaced apart at third intervals d231, d232, d233 and d234, respectively. In the hybrid multi-band antenna array 7, the third intervals d231, d232, d233 and d234 are between 0.1 wavelength and 0.7 wavelength of the lowest operating frequency of the second communication band 7252, and path lengths of the plurality of meandered metal resonant paths 7111, 7121, 7131 and 7141 from the loop feeding points 7113, 7123, 7133 and 7143 to the loop shorting points 7112, 7122, 7132 and 7142 are between 0.5 wavelength and 2.0 wavelength of the lowest operating frequency of the first communication band. Therefore, the coupling interference of near-field radiation energy of the first antenna array 71 and the second antenna array 72 could be reduced effectively. The hybrid multi-band antenna array 7 could achieve the same characteristics as the hybrid multi-band antenna array 2 does. This makes destructive interference on the multibeam radiation pattern of the first antenna array 71 and the second antenna array 72 to be reduced successfully, and the requirements of compact size, high integration and multi-band operation to be achieved successfully. The hybrid multi-band antenna array 7 according to this disclosure could be singly or in plural realized in a communication device. The communication device could be a mobile communication device, a wireless communication device, a mobile operating device, a computer system, telecom equipment, base station equipment, network equipment, or peripheral equipment, such as a computer and a network.

Figure 8A:
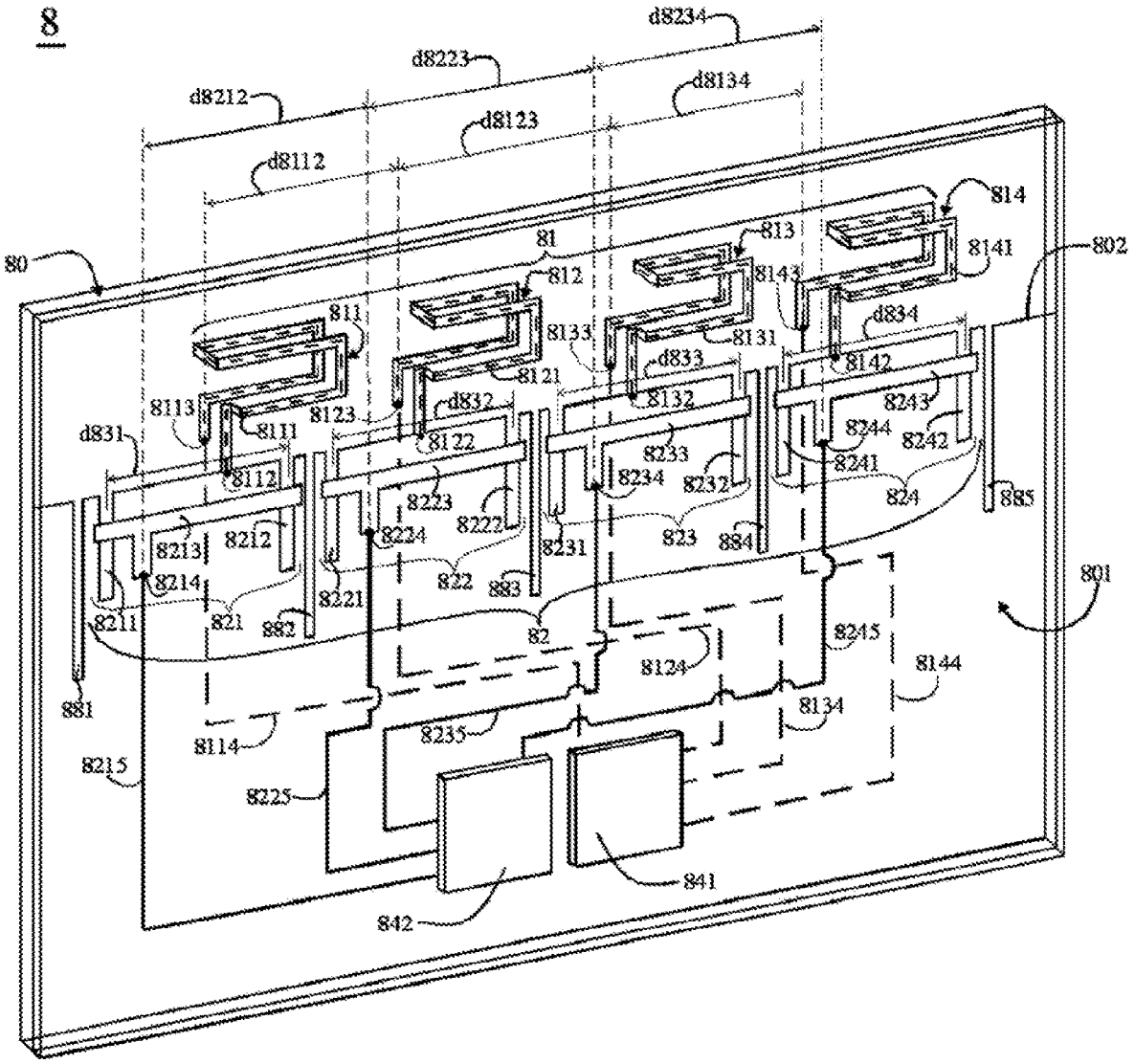
FIG. 8A is a structural diagram of a hybrid multi-band antenna array 8 of an embodiment according to this disclosure.
Figure 8B:
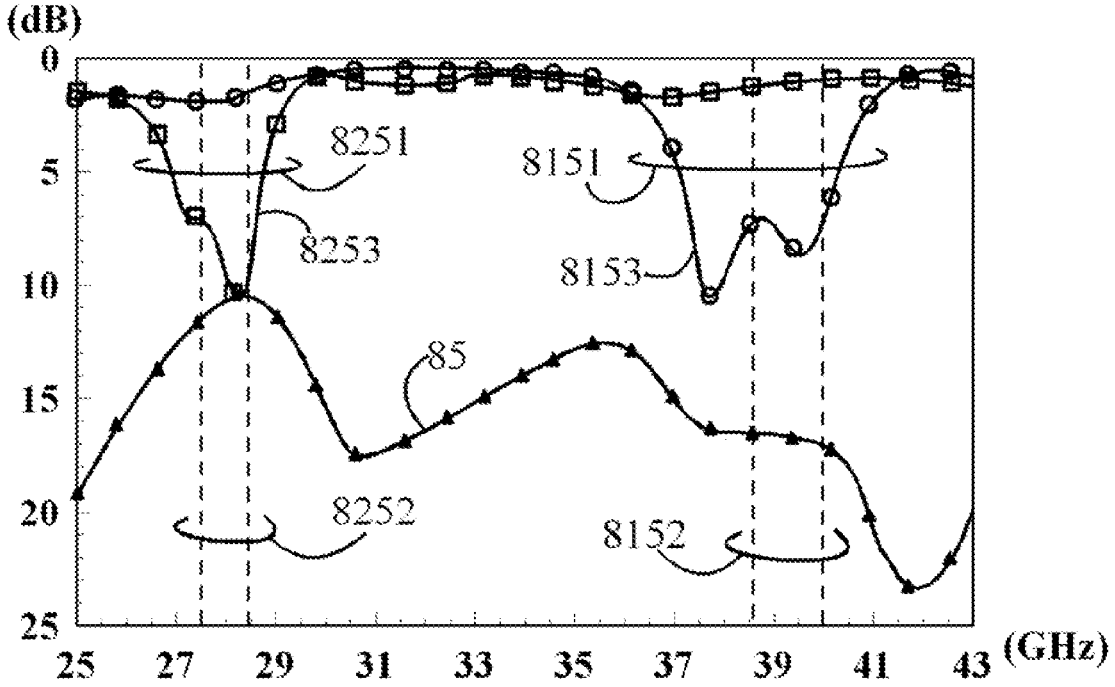
FIG. 8B is return loss and isolation curve diagrams of a hybrid multi-band antenna array 8 of an embodiment according to this disclosure.

FIG. 8A is a structural diagram of a hybrid multi-band antenna array 8 of an embodiment according to this disclosure. FIG. 8B is return loss and isolation curve diagrams of the hybrid multi-band antenna array 8 of an embodiment according to this disclosure. The hybrid multi-band antenna array 8 comprises a multilayer substrate board 80, a first antenna array 81 and a second antenna array 82. The multilayer substrate board 80 includes a ground conductor structure 801 having a first edge 802. The ground conductor structure 801 is a ground conductor plane. The first antenna array 81 comprises a plurality of folded loop antennas 811, 812, 813 and 814. The plurality of folded loop antennas 811, 812, 813 and 814 are integrated with the multilayer substrate board 80, and arranged along the first edge 802 sequentially. The folded loop antennas 811, 812, 813 and 814 have their respective meandered metal resonant paths 8111, 8121, 8131 and 8141. The meandered metal resonant path 8111 、8121 、8131 、3141 have their respective loop shorting points 8112, 8122, 8132 and 8142 and loop feeding points 8113, 8123, 8133 and 8143. The loop shorting points 8112, 8122, 8132 and 8142 are electrically connected to the ground conductor structure 801. The loop feeding points 8113, 8123, 8133 and 8143 are spaced apart at first intervals d8112, d8123 and d8134, respectively. The first antenna array 81 is excited to generate a first resonant mode 8151 that covers at least one first communication band 8152 (as shown in FIG. 8B). The second antenna array 82 comprises a plurality of parallel-connected slot antennas 821, 822, 823 and 824. The plurality of parallel-connected slot antennas 821, 822, 823 and 824 are integrated with the multilayer substrate board 80, and arranged along the first edge 802 sequentially. The parallel-connected slot antennas 821, 822, 823 and 824 comprise first slots 8211, 8221, 8231 and 8241, second slots 8212, 8222, 8232 and 8242, and signal coupling lines 8213, 8223, 8233 and 8243 extending across the first slots 8211, 8221, 8231 and 8241 and the second slots 8212, 8222, 8232 and 8242, respectively. The plurality of first slots 8211, 8221, 8231 and 8241 and the plurality of second slots 8212, 8222, 8232 and 8242 are disposed on the ground conductor structure 801. The plurality of signal coupling lines 8213, 8223, 8233 and 8243 have their respective slot feeding points 8214, 8224, 8234 and 8244. The slot feeding points 8214, 8224, 8234 and 8244 are spaced apart at second intervals d8212, d8223 and d8234, respectively. The second antenna array 82 is excited to generate a second resonant mode 8251 that covers at least one second communication band 8252. The frequency of the second resonant mode 8251 is lower than the frequency of the first resonant mode 8151 (as shown in FIG. 8B). The parallel-connected slot antennas 821, 822, 823 and 824 are spaced apart at third slots 882, 883 and 884, respectively. The third slots are disposed on the ground conductor structure 801. Slot lengths from opening ends to closing ends of the third slots 882, 883 and 884 are less than or equal to 0.8 wavelength of the lowest operating frequency of the second communication band 8252. The first intervals d8112, d8123 and d8134 are between 0.23 wavelength and 0.85 wavelength of the lowest operating frequency of the first communication band 8152. The second intervals d8212, d8223 and d8234 are between 0.23 wavelength and 0.85 wavelength of the lowest operating frequency of the second communication band 8252. The central point positions of the opening of the first slots 8211, 8221, 8231 and 8241 of the plurality of parallel-connected slot antennas 821, 822, 823 and 824 are spaced apart from the central point positions of the openings of the second slots 8212, 8222, 8232 and 8242 at third intervals d831, d832, d833 and d834, respectively. The third intervals d831, d832, d833 and d834 are between 0.1 wavelength and 0.7 wavelength of the lowest operating frequency of the second communication band 8252. Path lengths of the plurality of meandered metal resonant paths 8111, 8121, 8131 and 8141 from the loop feeding points 8113, 8123, 8133 and 8143 to the loop shorting points 8112, 8122, 8132 and 8142 are between 0.5 wavelength and 2.0 wavelength of the lowest operating frequency of the first communication band 8152. Path widths of the plurality of meandered metal resonant paths 8111, 8121, 2131 and 8141 are less than or equal to 0.25 wavelength of the lowest operating frequency of the first communication band 8152. Slot lengths from opening ends to closing ends of the plurality of first slots 8211, 8221, 8231 and 8241 and the plurality of second slots 8212, 8222, 8232 and 8242 are less than or equal to 0.6 wavelength of the lowest operating frequency of the second communication band 8252. Slot widths of the plurality of first slots 8211, 8221, 8231 and 8241 and the plurality of second slots 8212, 8222, 8232 and 8242 are less than or equal to 0.2 wavelength of the lowest operating frequency of the second communication band 8252.

Figure 8C:
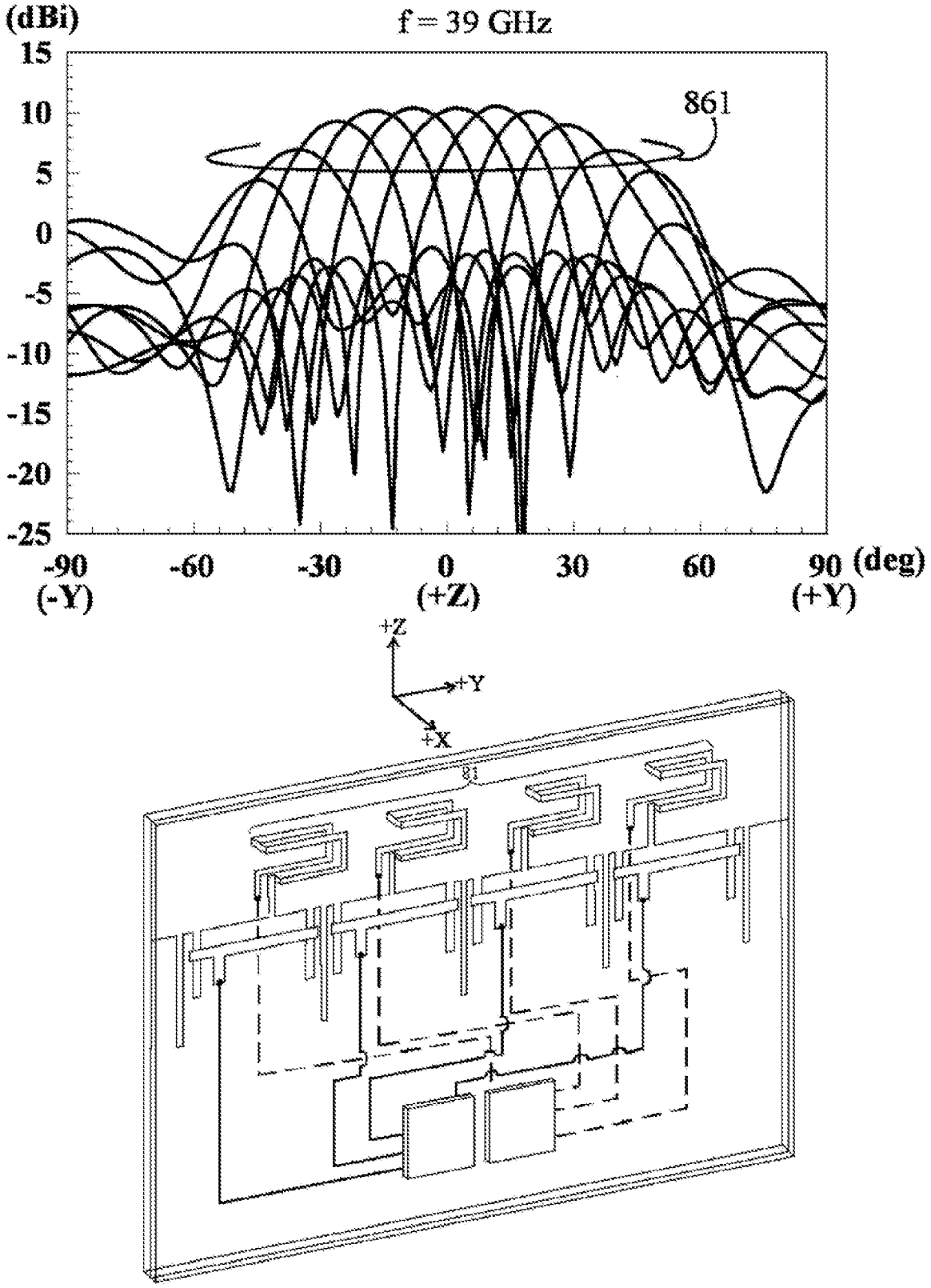
FIG. 8C is a multibeam scanning 2D radiation pattern diagram of a first antenna array 81 of a hybrid multi-band antenna array 8 in a first communication band of an embodiment according to this disclosure.
Figure 8D:
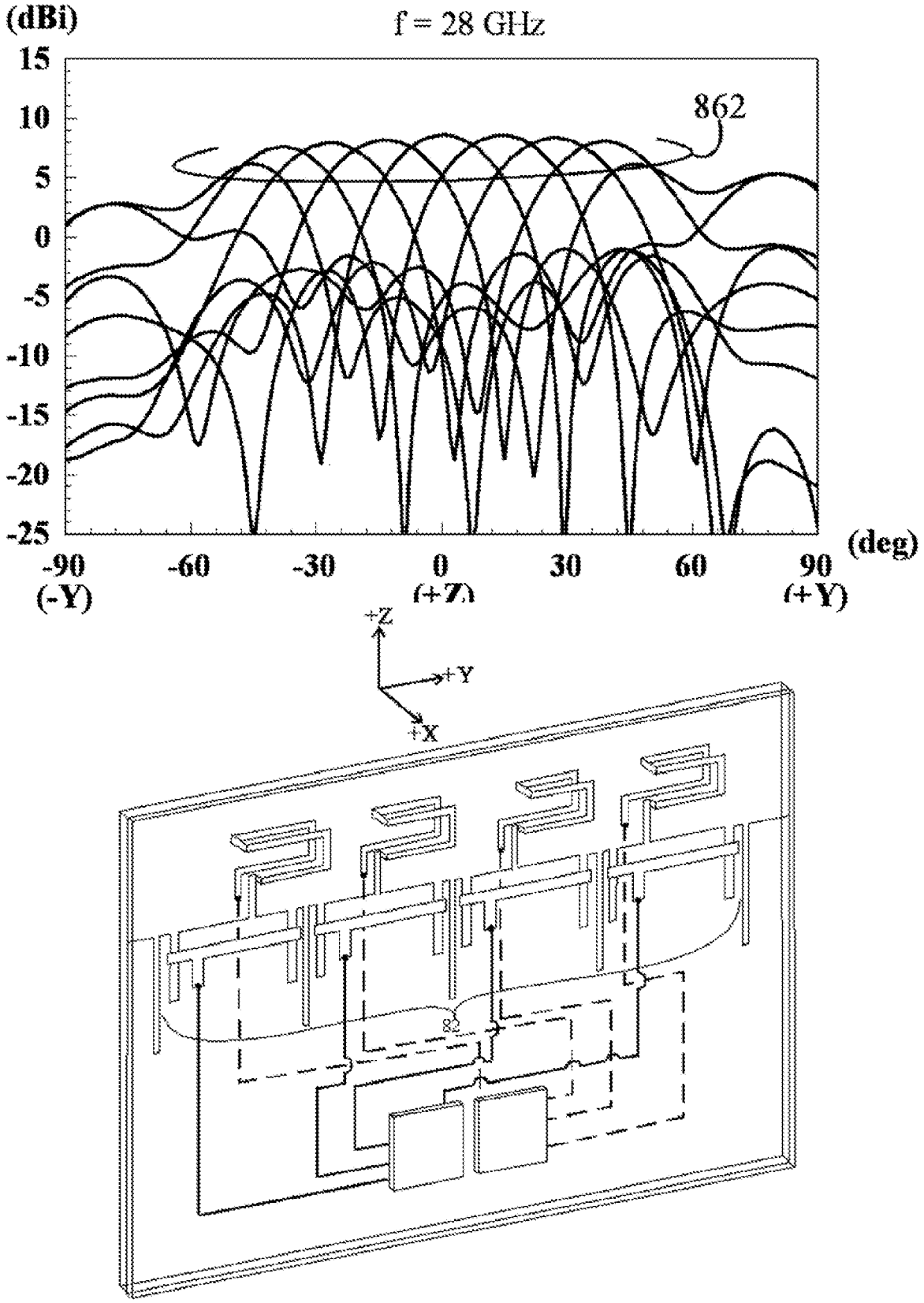
FIG. 8D is a multibeam scanning 2D radiation pattern diagram of a second antenna array 82 of a hybrid multi-band antenna array 8 in a second communication band of an embodiment according to this disclosure.

The loop feeding points 8113, 8123, 8133 and 8143 are electrically coupled through first antenna array transmission lines 8114, 8124, 8134 and 8144, respectively, to a first beamforming circuit 841. The slot feeding points 8214, 8224, 8234 and 8244 are electrically coupled through second antenna array transmission lines 8215, 8225, 8235 and 8245, respectively, to a second beamforming circuit 842. The first antenna array transmission lines 8114, 8124, 8134 and 8144 and the second antenna array transmission lines 8215、8225、8235、8245 could be a microstrip transmission line architecture, a sandwiched strip line architecture, a co-axial transmission line architecture, a co-planar waveguide transmission line architecture, a ground co-planar waveguide transmission line architecture, a combination thereof, or an improved architecture. The first beamforming circuit 841 excites the first antenna array 81 to generate the first resonant mode 8151. The first beamforming circuit 841 could generate signals with different phases, allowing the first antenna array 81 to generate different radiation patterns (as shown in FIG. 8C). The second beamforming circuit 842 excites the second antenna array 82 to generate the second resonant mode 8251. The second beamforming circuit 842 could generate signals with different phases, allowing the second antenna array 82 to generate different radiation patterns (as shown in FIG. 8D). The first beamforming circuit 841 and the second beamforming circuit 842 could be a power combining circuit, a phase controlling circuit, a frequency up-down-conversion circuit, an impedance matching circuit, an amplifier circuit, an integrated circuit chip or a radio frequency module.

FIG. 8A discloses the hybrid multi-band antenna array 8 of an embodiment according this disclosure, in which the plurality of signal coupling lines 8213, 8223, 8233 and 8243 and the plurality of signal coupling lines 2213, 2223, 2233 and 2243 of the hybrid multi-band antenna array 2 do not have exactly the same shapes, and the parallel-connected slot antennas 821, 822, 823 and 824 are spaced apart at third slots 882, 883 and 884, respectively. The third slots are disposed on the ground conductor structure 801. However, in the hybrid multi-band antenna array 8 according to this disclosure the first antenna array 81 is still excited to generate a first resonant mode 8151 that covers at least one first communication band 8152 (as shown in FIG. 8B) successfully, the second antenna array 82 is also excited to generate a second resonant mode 8251 that covers at least one second communication band 8252 successfully, and the frequency of the second resonant mode 8251 is lower than the frequency of the first resonant mode 8151 (as shown in FIG. 8B), the first intervals d8112, d8123 and d8134 are between 0.23 wavelength and 0.85 wavelength of the lowest operating frequency of the first communication band 8152, and the second intervals d8212, d8223 and d8234 are between 0.23 wavelength and 0.85 wavelength of the lowest operating frequency of the second communication band 8252. Therefore, the coupling interference of far-field radiation energy of the first antenna array 81 and the second antenna array 82 could also be reduced effectively. The central point positions of the openings of the first slots 8211, 8221, 8231 and 8241 of the plurality of parallel-connected slot antennas 821, 822, 823 and 824 are spaced apart from the central point positions of the openings of the second slots 8212, 8222, 8232 and 8242 at third intervals d231, d232, d233 and d234, respectively. In the hybrid multi-band antenna array 8 according to this disclosure, the third intervals d831, d832, d833 and d834 are between 0.1 wavelength and 0.7 wavelength of the lowest operating frequency of the second communication band 8252, and path lengths of the plurality of meandered metal resonant paths 8111, 8121, 8131 and 8141 from the loop feeding points 8113, 8123, 8133 and 8143 to the loop shorting points 8112, 8122, 8132 and 8142 are between 0.5 wavelength and 2.0 wavelength of the lowest operating frequency of the first communication band 8152. Therefore, the coupling interference of near-field radiation energy of the first antenna array 81 and the second antenna array 82 could also be reduced effectively. The hybrid multi-band antenna array 8 could achieve the same characteristics as the hybrid multi-band antenna array 2 does. Hence, the destructive interference on the multibeam radiation pattern of the first antenna array 81 and the second antenna array 82 could also be reduced, and the requirements of compact size, high integration and multi-band operation could also be achieved successfully.

FIG. 8B is return loss and isolation curve diagrams of the hybrid multi-band antenna array 8 of an embodiment according to this disclosure. The first antenna array 81 has a return loss curve 8153. The second antenna array 82 has a return loss curve 8253. The first antenna array 81 and the second antenna array 82 have isolation curves 85. In experiments, the first edge 802 of the ground conductor plane 801 is about 45 mm long, a path length of the meandered metal resonant path 8111 from the loop feeding point 8113 to the loop shorting point 8112 is about 12.9 mm, a path length of the meandered metal resonant path 8121 from the loop feeding point 8123 to the loop shorting point 8122 is about 13.3 mm, a path length of the meandered metal resonant path 8131 from the loop feeding point 8133 to the loop shorting point 8132 is about 13.3 mm, a path length of the meandered metal resonant path 8141 from the loop feeding point 8143 to the loop shorting point 8142 is about 12.9 mm, the first interval d8112 is about 4 mm, the first interval d8123 is about 4.3 mm, the first interval d8134 is about 4.1 mm, the second interval d8212 is about 5.1 mm, the second interval d8223 is about 5 mm, the second interval d8234 is about 5.1 mm, the third interval d831 is about 4.25 mm, the third interval d832 is about 4 mm, the third interval d833 is about 4 mm, the third interval d834 is about 4.15 mm. The multilayer substrate board 80 is a two-layered medium substrate in a total thickness of about 0.55 mm with a dielectric constant of the medium substrate about 3.5. As shown in FIG. 8B, the first antenna array 821 is excited to generate a first resonant mode 8151 that covers at least one first communication band 8152. As shown in FIG. 8B, the second antenna array 82 is excited to generate a second resonant mode 8251 that covers at least one second communication band 8252. The frequency of the second resonant mode 8251 is lower than the frequency of the first resonant mode 8151. In an embodiment, the first resonant mode 8151 covers at least one first communication band 8152 (38.5 GHz-40 GHz), the second resonant mode 8251 covers at least one second communication band 8252 (27.5 GHz-28.5 GHz), and the frequency of the second resonant mode 8251 is lower than the frequency of the first resonant mode 8151. The lowest operating frequency of the first communication band 8152 is about 38.5 GHz. The lowest operating frequency of the second communication band 8252 is about 27.5 GHz. As shown in FIG. 8B, the isolation curves 85 of the first antenna array 81 and the second antenna array 22 are better than 15 dB in the first communication band 8152 and are better than 10 dB in the second communication band 8252, which prove well enough for the isolation performance.

FIG. 8C is a multibeam scanning 2D radiation pattern diagram of a first antenna array 81 of the hybrid multi-band antenna array 8 in a first communication band of an embodiment according to this disclosure. FIG. 8D is a multibeam scanning 2D radiation pattern diagram of a second antenna array 82 of the hybrid multi-band antenna array 8 in a second communication band of an embodiment according to this disclosure. It could be clearly seen from the variation curve 861 of multibeam 2D radiation pattern of the first antenna array 81 of FIG. 8C and the variation curve 862 of multibeam 2D radiation pattern of the second antenna array 82 of FIG. 8D that far-field main radiation beams of the first antenna array 81 and the second antenna array 82 in different frequency bands could coexist and cooperate, and do not destruct and offset by each other, which proves that multi-band wireless communication transmission could be achieved successfully.

The communication band operations, the experimental data, the number of layers of the substrate board, and the number of layers of the ground conductor plane covers in FIGS. 8B-8D are proposed to prove the technical effect of the hybrid multi-band antenna array 8 of an embodiment according to this disclosure of FIG. 8A, and are not used to limit the communication band operations, applications and specifications encompassed in practical applications of the hybrid multi-band antenna array 8 according to this disclosure. The hybrid multi-band antenna array 8 according to this disclosure could be singly or in plural realized in a communication device. The communication device could be a mobile communication device, a wireless communication device, a mobile operating device, a computer system, telecom equipment, base station equipment, network equipment, or peripheral equipment, such as a computer and a network.

This disclosure provides a highly integrated multi-band multibeam antenna array, which has a reduced overall size and could be applied to a communication device. Therefore, the practical application demand of a high data rate multi-antenna communication device could be satisfied.

It will be apparent to those skilled in the art that various modifications and variations could be made to the disclosed embodiments. It is intended that the specification and examples be considered as exemplary only, with a true scope of the disclosure being indicated by the following claims and their equivalents.

What is claimed is:

1. A hybrid multi-band antenna array, comprising:

a multilayer substrate board including a ground conductor structure having a first edge;

a first antenna array including a plurality of folded loop antennas, all of the folded loop antennas being integrated with the multilayer substrate board and arranged along the first edge sequentially, wherein each of the folded loop antennas includes a meandered metal resonant path, each of the meandered metal resonant paths has a loop shorting point and a loop feeding point, each of the loop shorting point is electrically connected to the ground conductor structure, two neighboring ones of the loop feeding points are respectively spaced apart at a first interval, and the first antenna array is excited to generate a first resonant mode covering at least one first communication band; and a second antenna array including a plurality of parallel-connected slot antennas, all of the parallel-connected slot antennas being integrated with the multilayer substrate board and arranged along the first edge sequentially, wherein each of the parallel-connected slot antennas includes a first slot, a second slot, and a signal coupling line extending across the first slot and the second slot, all of the first slots and all of the second slots are disposed on the ground conductor structure, each of the signal coupling lines has a slot feeding point, any two neighboring ones of the slot feeding points are respectively spaced apart at a second interval, and the second antenna array is excited to generate a second resonant mode covering at least one second communication band, wherein the frequency of the second resonant mode is lower than the frequency of the first resonant mode.

2. The hybrid multi-band antenna array of claim 1, wherein the ground conductor structure is a ground conductor plane.

3. The hybrid multi-band antenna array of claim 1, wherein the ground conductor structure has multilayer ground conductor planes, and the multilayer ground conductor planes are electrically connected together through a plurality of ground conducting vias.

4. The hybrid multi-band antenna array of claim 1, wherein the first interval is between 0.23 wavelength and 0.85 wavelength of the lowest operating frequency of the first communication band.

5. The hybrid multi-band antenna array of claim 1, wherein the second interval is between 0.23 wavelength and 0.85 wavelength of the lowest operating frequency of the second communication band.

6. The hybrid multi-band antenna array of claim 1, wherein the central point position of an opening of the first slot and the central point position of an opening of the second slot of each of the parallel-connected slot antennas are spaced apart at a third interval between 0.1 wavelength and 0.7 wavelength of the lowest operating frequency of the second communication band.

7. The hybrid multi-band antenna array of claim 1, wherein a path length of each of the meandered metal resonant paths from the loop feeding point to the loop shorting point is between 0.5 wavelength and 2.0 wavelength of the lowest operating frequency of the first communication band.

8. The hybrid multi-band antenna array of claim 1, wherein the loop feeding points are electrically coupled to a first beamforming circuit through respective transmission lines.

9. The hybrid multi-band antenna array of claim 8, wherein the first beamforming circuit is a power combining circuit, a phase controlling circuit, a frequency up-down-conversion circuit, an impedance matching circuit, an amplifier circuit, an integrated circuit chip or a radio frequency module.

10. The hybrid multi-band antenna array of claim 1, wherein the slot feeding points are electrically coupled to a second beamforming circuit through respective transmission lines.

11. The hybrid multi-band antenna array of claim 10, wherein the second beamforming circuit is a power combining circuit, a phase controlling circuit, a frequency up-down-conversion circuit, an impedance matching circuit, an amplifier circuit, an integrated circuit chip or a radio frequency module.

12. The hybrid multi-band antenna array of claim 1, wherein the loop feeding points and the slot feeding points are electrically coupled to a third beamforming circuit through respective transmission lines.

13. The hybrid multi-band antenna array of claim 12, wherein the third beamforming circuit is a power combining circuit, a phase controlling circuit, a frequency up-down-conversion circuit, an impedance matching circuit, an amplifier circuit, an integrated circuit chip or a radio frequency module.

14. The hybrid multi-band antenna array of claim 1, wherein a portion of the plurality of folded loop antennas and a portion of the plurality of parallel-connected slot antennas are arranged to be overlapped along the first edge.

15. The hybrid multi-band antenna array of claim 1, further comprising a plurality of third slots disposed on the ground conductor structure, wherein each of the third slots is disposed between any two neighboring ones of the parallel-connected slot antennas.

* * * * *